US009823603B2

(12) United States Patent
Murakami et al.

(10) Patent No.: US 9,823,603 B2
(45) Date of Patent: Nov. 21, 2017

(54) FEEDING DEVICE, CLEANING DEVICE, DEVELOPING DEVICE, PROCESS CARTRIDGE, AND IMAGE FORMING APPARATUS

(71) Applicant: CANON KABUSHIKI KAISHA, Tokyo (JP)

(72) Inventors: Ryuta Murakami, Suntou-gun (JP); Noriyuki Komatsu, Numazu (JP); Naoki Maeda, Suntou-gun (JP); Takatoshi Hamada, Mishima (JP); Hiroaki Nosho, Suntou-gun (JP); Naoki Matsumaru, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/288,096

(22) Filed: Oct. 7, 2016

(65) Prior Publication Data

US 2017/0108802 A1 Apr. 20, 2017

(30) Foreign Application Priority Data

Oct. 14, 2015 (JP) ..... 2015-202499

(51) Int. Cl.
*G03G 15/08* (2006.01)
*G03G 15/095* (2006.01)
*G03G 21/18* (2006.01)

(52) U.S. Cl.
CPC ..... *G03G 15/0891* (2013.01); *G03G 15/095* (2013.01); *G03G 21/18* (2013.01)

(58) Field of Classification Search
CPC combination set(s) only.
See application file for complete search history.

(56) References Cited

U.S. PATENT DOCUMENTS 6,085,062 A 7/2000 Mizuishi et al.
7,689,157 B2 3/2010 Tanaka
(Continued)

FOREIGN PATENT DOCUMENTS

JP 2007-286371 A 11/2007
JP 2009-210649 A 9/2009
JP 2010-078797 A 4/2010

OTHER PUBLICATIONS

European Search Report dated Mar. 17, 2017, in related European Patent Application No. 16193451.8.
(Continued)

*Primary Examiner* — Clayton E Laballe
*Assistant Examiner* — Jas Sanghera
(74) *Attorney, Agent, or Firm* — Fitzpatrick, Cella, Harper & Scinto

(57) ABSTRACT

A feeding device for feeding a developer includes an accommodating member, a first helical feeding member including a first region having a first diameter and a second region having a second diameter smaller than the first diameter in a named order with respect to a first feeding direction, a second helical feeding member for feeding the developer in a second feeding direction crossing the first feeding direction, and a wall extending toward the second helical feeding member so that the wall is spaced from the first helical feeding member toward a downstream side of the first helical feeding member with respect to the first feeding direction to branch a flow path of the developer. With respect to the first feeding direction, the second region is provided between the first region and a position where the first and second helical feeding members cross each other.

25 Claims, 18 Drawing Sheets

(56) References Cited

U.S. PATENT DOCUMENTS

| | | | | |
|---|---|---|---|---|
| 2006/0165440 | A1 | 7/2006 | Adachi | |
| 2007/0147859 | A1* | 6/2007 | Adachi | G03G 15/0872 399/35 |
| 2007/0242993 | A1* | 10/2007 | Tanaka | G03G 15/0865 399/358 |
| 2008/0170885 | A1 | 7/2008 | Hatakeyama et al. | |
| 2010/0067931 | A1 | 3/2010 | Izumi et al. | |
| 2012/0213554 | A1* | 8/2012 | Hayashi | G03G 15/0893 399/254 |
| 2013/0071165 | A1 | 3/2013 | Kitamura | |
| 2014/0105649 | A1* | 4/2014 | Ota | G03G 15/0877 399/254 |

OTHER PUBLICATIONS

Naoki Maeda et al., U.S. Appl. No. 15/288,038, filed Oct. 7, 2016.
Hiroaki Nosho et al., U.S. Appl. No. 15/288,024, filed Oct. 7, 2016.
European Search Report dated Aug. 16, 2017, in related European Patent Application No. 16193451.8.

* cited by examiner (a)

(b)

(a)

(b)

(a)

(b)

FEEDING DEVICE, CLEANING DEVICE, DEVELOPING DEVICE, PROCESS CARTRIDGE, AND IMAGE FORMING APPARATUS

FIELD OF THE INVENTION AND RELATED ART

The present invention relates to a developer feeding device, a cleaning device, a developing device, a process cartridge, and an image forming apparatus using these devices or cartridge.

Here, the feeding device is a device for feeding a developer for use with the image forming apparatus to a predetermined place. For example, it is possible to cite a device for feeding a residual developer, remaining on a photosensitive drum after transfer, to a residual developer accommodating chamber.

Further, the process cartridge is such a cartridge that an image bearing member such as an electrophotographic photosensitive drum is at least provided and that the image bearing member and a process means actable on the image bearing member are integrally provided. Such a process cartridge is detachably mounted in a main assembly of the image forming apparatus. For example, it is possible to cite a process cartridge prepared by integrally assembling the electrophotographic photosensitive drum and, as the process means, at least one of a developing means, a charging means and a cleaning means into a cartridge.

Further, an electrophotographic image forming apparatus forms an image on a recording material (medium) using an electrophotographic image forming method. Examples of the electrophotographic image forming apparatus may include an electrophotographic copying machine, an electrophotographic printer (LED printer, laser beam printer or the like), a facsimile machine, a word processor and so on.

In the electrophotographic image forming apparatus, in general, a drum-shaped electrophotographic photosensitive member, i.e., a photosensitive drum as an image bearing member is electrically charged uniformly. Then, the charged photosensitive drum is selectively exposed to light, so that an electrostatic latent image is formed on the photosensitive drum. Then, the electrostatic latent image formed on the photosensitive drum is developed as a toner image with a toner as a developer. Then, the toner image formed on the photosensitive drum is transferred onto the recording material such as a recording sheet or a plastic sheet, and then the toner image transferred on the recording material is subjected to application of heat and pressure and thus is fixed on the recording material to effect image recording.

Such an image forming apparatus requires toner supply and maintenance of various process means in general. In order to facilitate the toner supply and the maintenance, a process cartridge in which the photosensitive drum, the charging means, the developing means, the cleaning means and the like are integrally assembled into a cartridge in a single frame is made detachably mountable to an image forming apparatus main assembly and has been put into practical use.

According to this process cartridge type, the maintenance of the devices can be made by a user himself (herself), and therefore operativity can be remarkably improved, so that it is possible to provide an image forming apparatus excellent in usability. For that reason, the process cartridge type has been widely used in the image forming apparatus.

In the above-described process cartridge, there arises a need to feed the developer to a distant position in some cases. At that time, a developer feeding device for delivering the developer by providing two helical feeding members for feeding the developer so that rotational axes thereof cross each other has been known (Japanese Laid-Open Patent Application (JP-A) 2007-286371).

However, with speed-up of printing, there is a need to feed the developer in a large amount per unit time. For that reason, there is a problem that a developer delivering performance between first and second feeding members which have a helical shape and crossing rotational axes could be improved.

SUMMARY OF THE INVENTION

A principal object of the present invention is to provide a feeding device, a cleaning device, a developing device, a process cartridge, and an image forming apparatus, in which a developer delivering performance between first and second feeding members of which developer feeding directions cross each other as seen from above is improved.

According to an aspect of the present invention, there is provided a feeding device for feeding a developer, comprising: an accommodating member for accommodating the developer; a first helical feeding member provided rotatably in the accommodating member and including a first region having a first diameter and a second region having a second diameter smaller than the first diameter in a named order with respect to a first feeding direction in which the developer is fed; a second helical feeding member, provided rotatably in the accommodating member, for feeding the developer in a second feeding direction crossing the first feeding direction; and a wall provided in the accommodating member and extending toward the second helical feeding member so that the wall is spaced from the first helical feeding member toward a downstream side of the first helical feeding member with respect to the first feeding direction to branch a flow path of the developer, wherein with respect to the first feeding direction, the second region is provided between the first region and a position where the first and second helical feeding members cross each other.

According to another aspect of the present invention, there is provided a feeding device for feeding a developer, comprising: an accommodating member for accommodating the developer; a first feeding member provided rotatably in the accommodating member and including a first region having a helical shape, a second region having a crank shape and a third region having a helical shape in a named order with respect to a rotational axis direction; and a second feeding member supported in the second region and reciprocating in a direction crossing the rotational axis direction by rotational motion of the first feeding member.

According to a further aspect of the present invention, there is provided a cleaning device, a developing device, a process cartridge, and an image forming apparatus which include the above-described feeding device.

Further features of the present invention will become apparent from the following description of exemplary embodiments with reference to the attached drawings.

DESCRIPTION OF THE EMBODIMENTS

Embodiments of the present invention will be described in detail with reference to the drawings. In the following description, a rotational axis direction of a photosensitive drum is a longitudinal direction. Further, with respect to the longitudinal direction, a side in which the photosensitive drum receives a driving force from an apparatus main assembly of an image forming apparatus is a driving side, and an opposite side thereof is a non-driving side.

First Embodiment (General Structure of Image Forming Apparatus)

Figure 2:
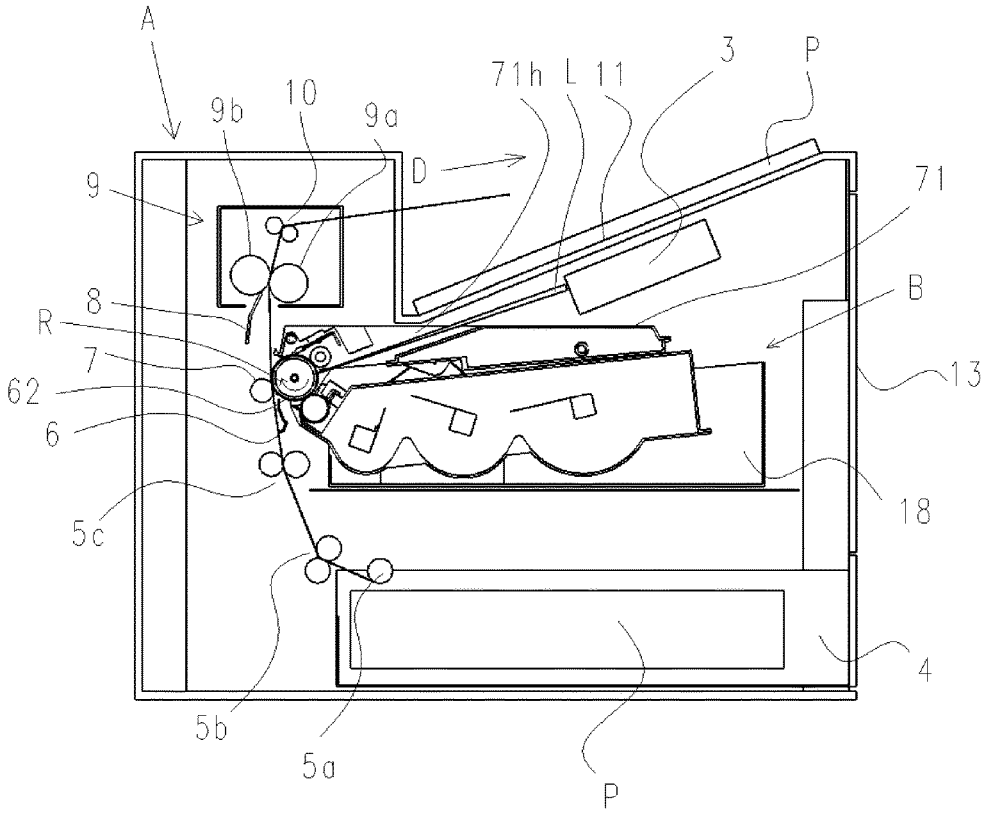
FIG. 2 is a sectional view showing a main assembly of an image forming apparatus in which the feeding device in the First Embodiment is mounted and showing a process cartridge.

FIG. 2 is a sectional view showing a main assembly of an image forming apparatus 1 (hereinafter referred to as an apparatus main assembly A) in which a feeding device according to this embodiment is mounted and showing a process cartridge (hereinafter referred to as a cartridge B). The apparatus main assembly A is a portion from which the cartridge B is removed.

The image forming apparatus shown in FIG. 2 is a laser beam printer using electrophotography in which the cartridge B is detachably mountable to the apparatus main assembly A. When the cartridge B is mounted in the apparatus main assembly A, an exposure device (laser scanner unit) 3 for forming an electrostatic latent image on an electrophotographic photosensitive drum (hereinafter referred to as a drum) 62 of the cartridge B is provided. Further, below the cartridge B, a sheet (feeding) tray 4 in which a recording material or medium (hereinafter referred to as a sheet material) P to be subjected to image formation is accommodated is provided.

Further, in the apparatus main assembly A, along a feeding direction D of the sheet material P, a pick-up roller 5*a*, a feeding roller pair 5*b*, a conveying roller pair 5*c*, a transfer guide 6, a transfer roller 7, a feeding guide 8, a fixing device 9, a discharging roller pair 10, a discharge tray 11 and the like are successively provided. The fixing device 9 is constituted by a heating roller 9*a* and a pressing roller 9*b*.

(Image Forming Process)

Figure 3:
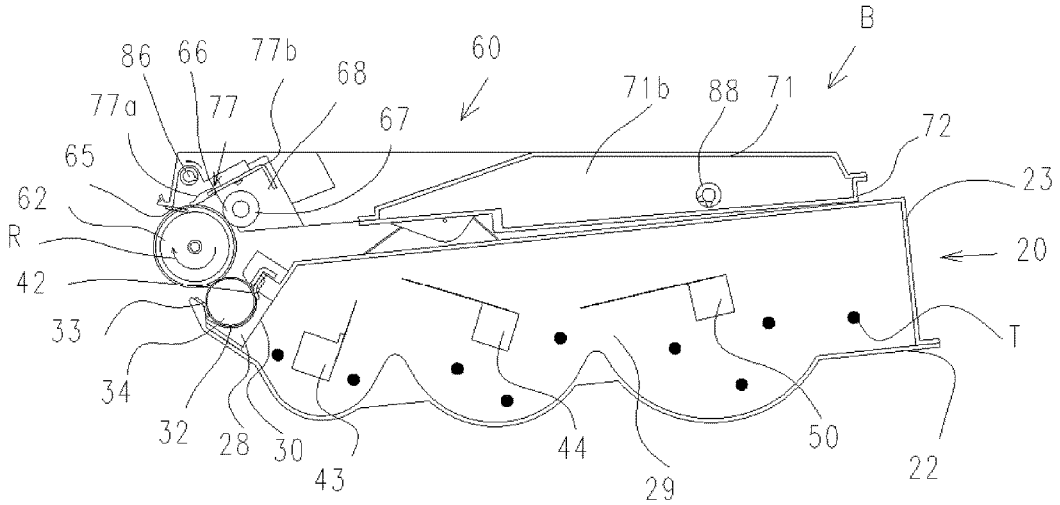
FIG. 3 is a sectional view of the process cartridge in which the feeding device in the First Embodiment is mounted.

An outline of an image forming process will be described using FIGS. 2 and 3. FIG. 3 is a sectional view of the cartridge B.

As shown in FIG. 2, on the basis of a print start signal, the drum 62 is rotationally driven at a predetermined peripheral speed (process speed) in an arrow R direction. Then, as shown in FIG. 3, a charging roller 66 to which a bias voltage is applied contacts the outer peripheral surface of the drum 62 and electrically charges the outer peripheral surface of the drum 62 uniformly.

The exposure device 3 outputs laser light L depending on image information as shown in FIG. 2. The laser light L passes through a laser opening 71*h* provided in a cleaning frame 71, so that the outer peripheral surface of the drum 62 is subjected to scanning exposure. As a result, on the outer peripheral surface of the drum 62, the electrostatic latent image depending on the image information is formed.

On the other hand, as shown in FIG. 3, a toner T in a toner chamber 29 provided in a developing unit 20 as a developing device is stirred and fed by rotation of a first stirring member 43, a second stirring member 44 and a third stirring member 50, thus being sent to a toner supplying chamber 28. The toner T is carried by a magnetic force of a magnet roller 34 (fixed magnet) on a surface of a developing roller 32. The toner T is regulated in layer thickness on the peripheral surface of the developing roller 32 by a developing blade 42 as a collecting member for collecting the developer while being triboelectrically charged. Thereafter, the toner T is supplied onto the drum 62 depending on the electrostatic latent image, so that the electrostatic latent image is visualized (developed) as a toner image.

As shown in FIG. 2, in synchronism with output timing of the laser light L, by the pick-up roller 5*a*, the feeding roller pair 5*b* and the conveying roller pair 5*c*, the sheet material P accommodated in the sheet tray 4 provided at a lower portion of the apparatus main assembly A is fed from the sheet tray 4. Then, the sheet material P is fed to a transfer position between the drum 62 and the transfer roller 7 via the transfer guide 6. In this transfer position, the toner image is successively transferred from the drum 62 onto the sheet material P.

The sheet material P on which the toner image is transferred is separated from the drum 62 and then is fed to the fixing device 9 along the conveying guide 8. Then, the sheet material P passes through a nip between the heating roller 9*a* and the pressing roller 9*b* which constitute the fixing device 9. At this nip, a pressure and heat-fixing process is effected, so that the toner image is fixed on the sheet material P. The sheet material P on which the toner image is fixed is fed to the discharging roller pair 10 and then is discharged onto the discharge tray 11 in an arrow D direction.

On the other hand, as shown in FIG. 3, from the drum 62 after the transfer, a residual toner remaining on the outer peripheral surface of the drum 62 is removed by a cleaning blade 77, and the drum 62 is used again in the image forming process. The residual toner removed from the drum 62 is stored in a residual toner chamber 71*b* of a cleaning unit 60.

(Mounting and Demounting of Cartridge Relative to Apparatus Main Assembly)

Figure 5:
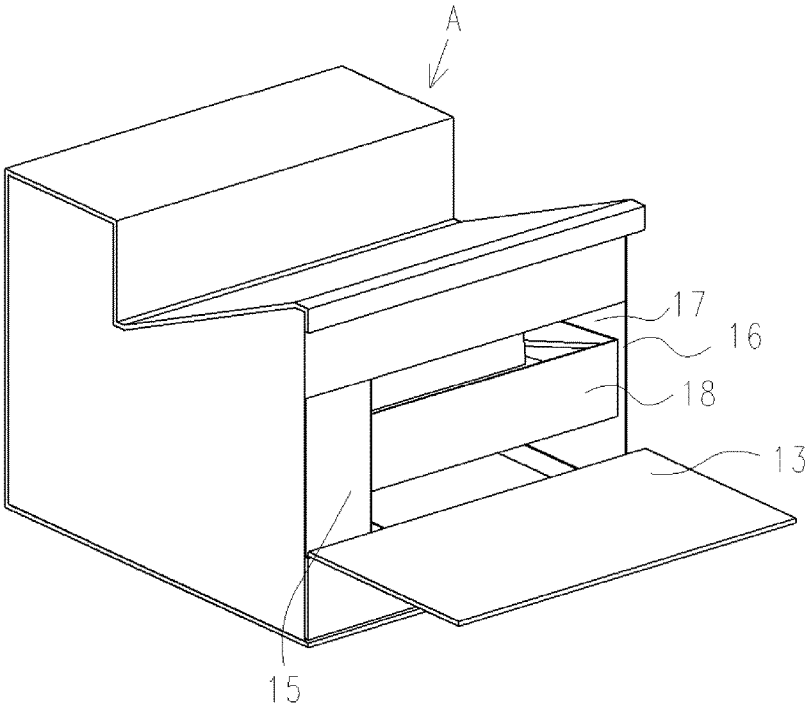
FIG. 5 is a perspective view of the image forming apparatus main assembly in a state in which an openable door of the image forming apparatus in which the feeding device in the First Embodiment is mounted is open.
Figure 6:
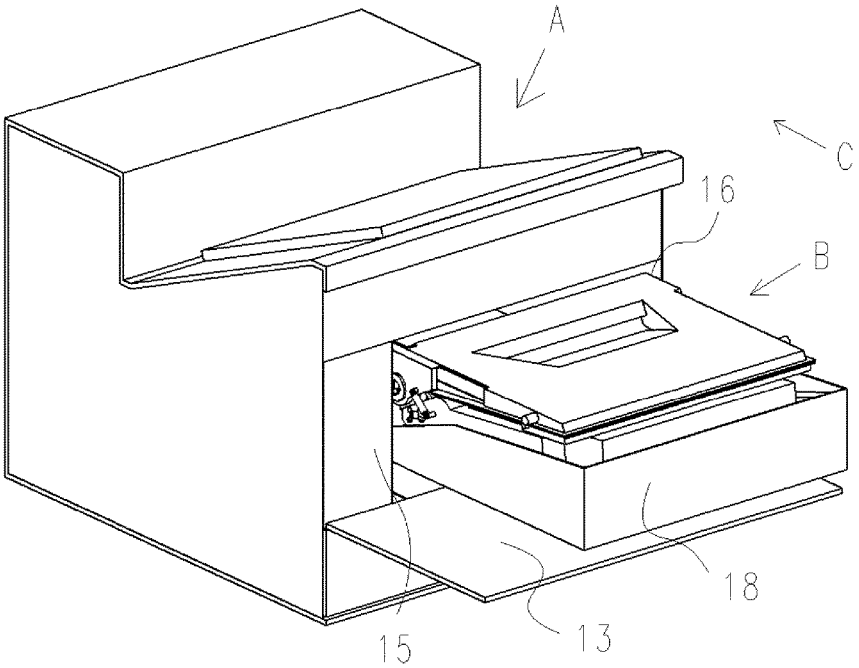
FIG. 6 is a perspective view of the image forming apparatus main assembly in a state in which the openable door of the image forming apparatus in which the feeding device in the First Embodiment is mounted is opened and then a tray is pulled out.
Figure 7:
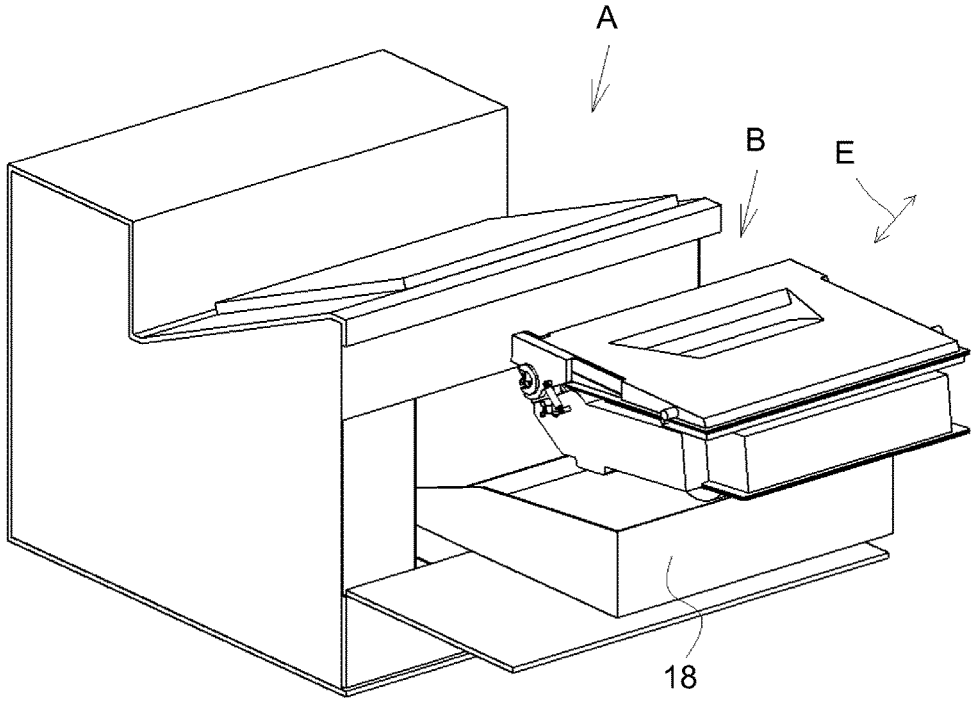
FIG. 7 is a perspective view of the image forming apparatus main assembly and the process cartridge when the process cartridge is mounted in and demounted from the tray in the state in which the openable door of the image forming apparatus in which the feeding device in the First Embodiment is mounted is opened and then the tray is pulled out.
Figure 8:
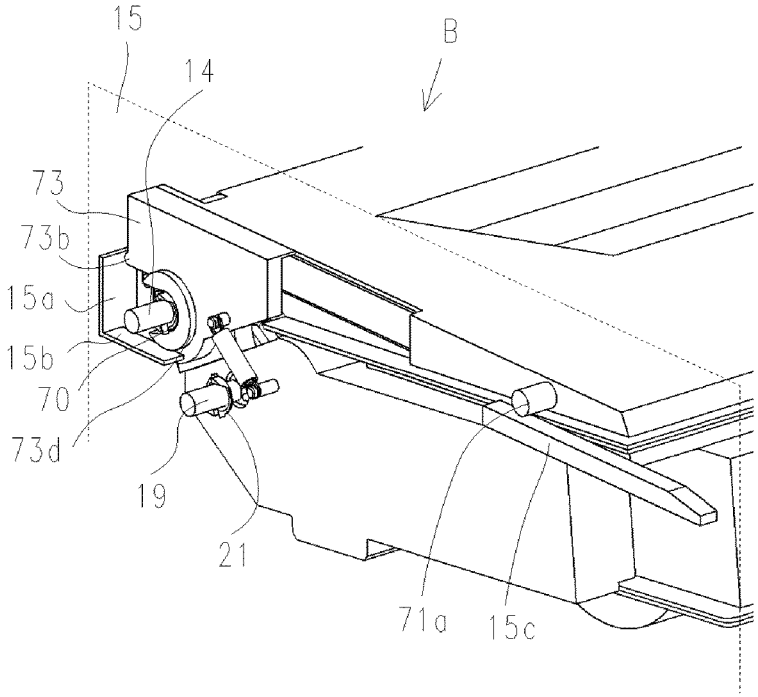
FIG. 8 is a perspective view showing a driving side positioning portion between the process cartridge and the image forming apparatus main assembly in a state in which the process cartridge is mounted in the image forming apparatus main assembly in the image forming apparatus in which the feeding device in the First Embodiment is mounted.

Next, mounting and demounting of the cartridge B will be described using FIGS. 5 to 8. FIG. 5 is a perspective view of the apparatus main assembly A of which an openable door 13 is opened for permitting mounting and demounting of the cartridge B. FIG. 6 is a perspective view of the apparatus main assembly A and the cartridge B in a state in which the openable door 13 is opened for permitting the mounting and demounting of the cartridge B and then a tray 18 is pulled out. FIG. 7 is a perspective view of the apparatus main assembly A and the cartridge B when the cartridge B is demounted and mounted in a state in which the openable door 13 is opened and then the tray 18 is pulled out. FIG. 8 is a perspective view of a driving side positioning portion between the cartridge B and the apparatus main assembly A in a state in which the cartridge B is mounted in the apparatus main assembly A.

As shown in FIG. 5, to the apparatus main assembly A, the openable door 13 is rotatably attached, and when the openable door 13 is opened, a cartridge inserting opening 17 is exposed. In the cartridge inserting opening 17, a tray 18 for mounting the cartridge B in the apparatus main assembly A is provided. As shown in FIG. 6, when the tray 18 is pulled out to a predetermined position, the cartridge B can be mounted and demounted. The cartridge B is inserted (mounted) in the apparatus main assembly A along a guide rail (not shown) in an arrow C direction in FIG. 6 in a state in which the cartridge B is placed on the tray 18. The mounting and demounting of the cartridge B relative to the tray 18 are made along an arrow E direction in FIG. 7.

The apparatus main assembly A is provided with a first driving shaft 14 and a second driving shaft 19 as shown in FIG. 8. The first driving shaft 14 transmits a driving force to a first coupling 70 of the cartridge B. The second driving shaft 19 transmits a driving force to a second coupling 21. The first driving shaft 14 and the second driving shaft 19 are driven by a motor (not shown) of the apparatus main assembly A. As a result, the drum 62 connecting with the first coupling 70 receives the driving force from the apparatus main assembly A and is rotated.

The developing roller 32 is rotated by transmission of the driving force from the second coupling 21. Further, to the charging roller 66 and the developing roller 32, a predetermined bias voltage is applied by an electric power supplying portion (not shown) of the apparatus main assembly A.

(Cartridge Supporting Structure of Apparatus Main Assembly)

Figure 9:
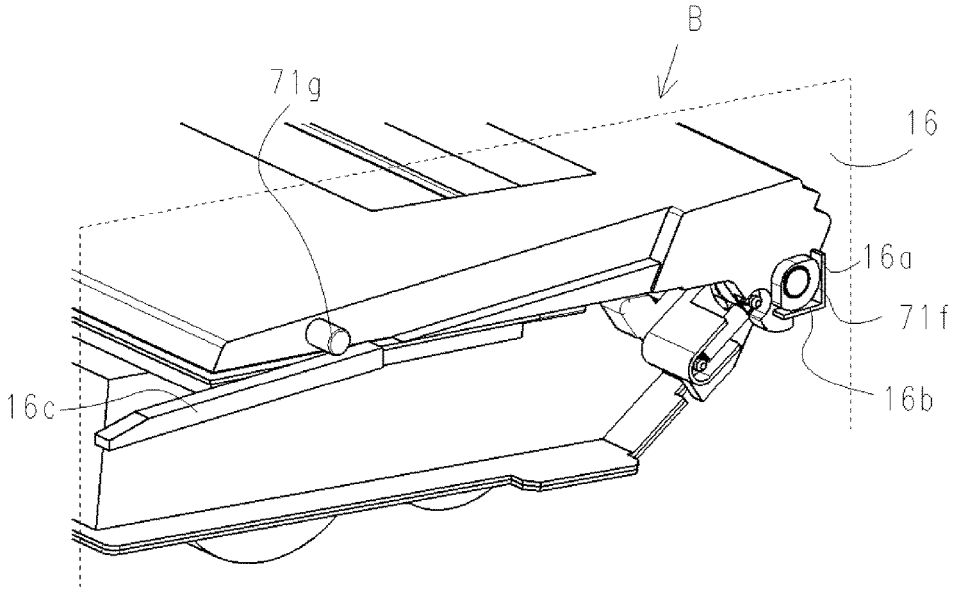
FIG. 9 is a perspective view showing a non-driving side positioning portion between the process cartridge and the image forming apparatus main assembly in the state in which the process cartridge is mounted in the image forming apparatus main assembly in the image forming apparatus in which the feeding device in the First Embodiment is mounted.

Next, a supporting structure of the cartridge B by the apparatus main assembly A will be described using FIGS. 5, 8 and 9. FIG. 5 is a perspective view of the apparatus main assembly A of which an openable door 13 is opened for permitting mounting and demounting of the cartridge B. FIG. 8 is a perspective view of a driving side positioning portion between the cartridge B and the apparatus main assembly A in a state in which the cartridge B is mounted in the apparatus main assembly A. FIG. 9 is a perspective view of a non-driving side positioning portion between the cartridge B and the apparatus main assembly A in a state in which the cartridge B is mounted in the apparatus main assembly A.

As shown in FIG. 5, the apparatus main assembly A is provided with a driving side-side plate 15 and the non-driving side-side plate 16 for supporting the cartridge B. As shown in FIG. 8, the driving side-side plate 15 is provided with a driving side-first supporting portion 15*a*, a driving side-second supporting portion 15*b* and a rotation supporting portion 15*c* for the cartridge B. As shown in FIG. 9, the non-driving side-side plate 16 is provided with a non-driving side-first supporting portion 16*a*, a non-driving side-second supporting portion 16*b* and a rotation supporting portion 16*c* for the cartridge B.

On the other hand, as driving side portions-to-be-supported of the cartridge B, a portion-to-be-supported 73*b* and a portion-to-be-supported 73*d* of a drum bearing 73, and a driving side boss 71*a* are provided as shown in FIG. 8. The portion-to-be-supported 73*b* is supported by the driving side-first supporting portion 15*a*, the portion-to-be-supported 73*d* is supported by the driving side-second supporting portion 15*b*, and the driving side boss 71*a* is supported by the rotation supporting portion 15*c*. Further, as non-driving side portions-to-be-supported, as shown in FIG. 9, a non-driving side projection 71*f* and a non-driving side boss 71*g* are provided. The non-driving side projection 71*f* is supported by the non-driving side-first supporting portion 16*a* and the non-driving side-second supporting portion 16*b*, and the non-driving side boss 71*g* is supported by the rotation supporting portion 16*c*. By the above-described structure, the cartridge B is positioned inside the apparatus main assembly A.

(General Structure of Cartridge)

Figure 4:
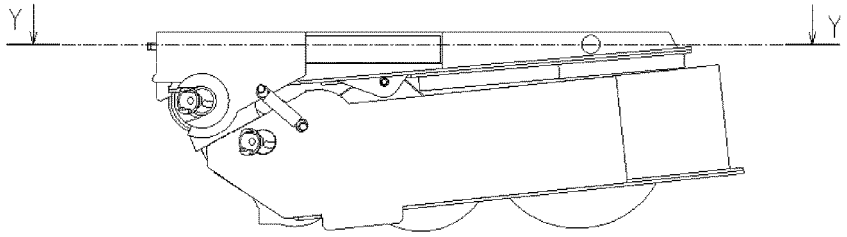
In FIG. 4, (a) is a side view of the process cartridge in which the feeding device in the First Embodiment is mounted, and (b) is a sectional view showing an inside of a cleaning frame.
Figure 4:
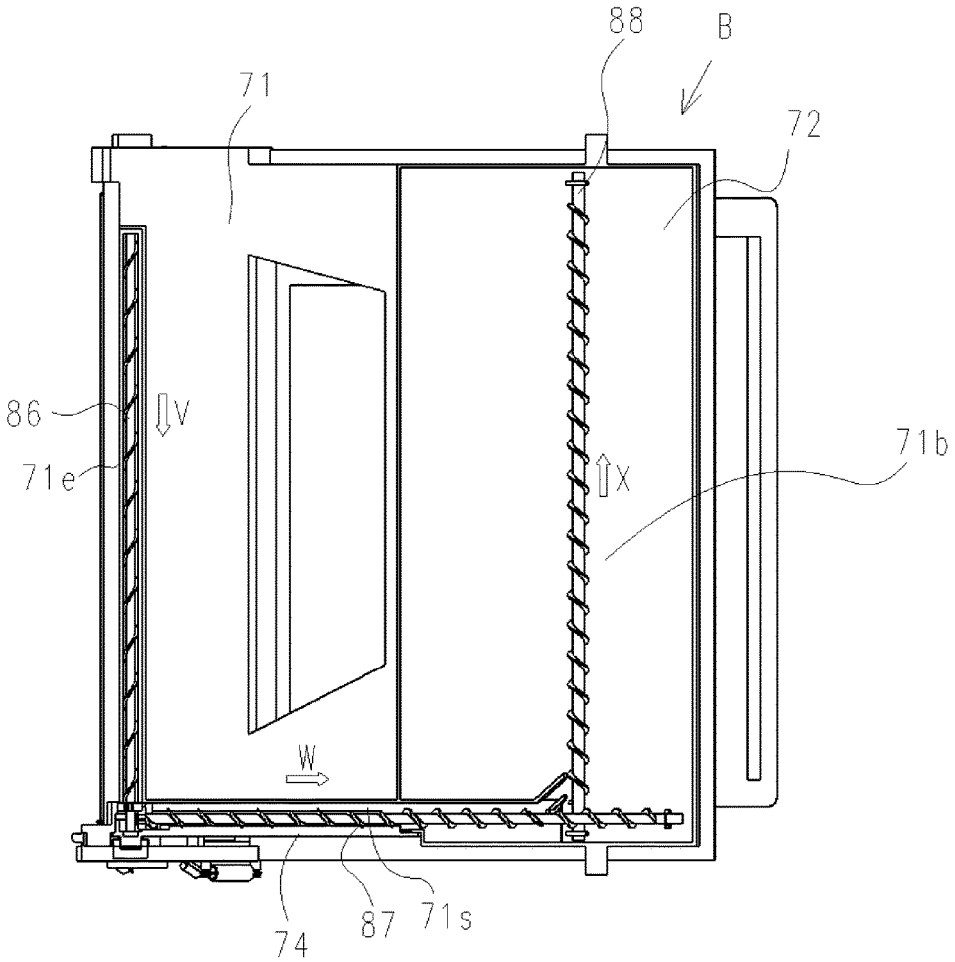
Figure 10:
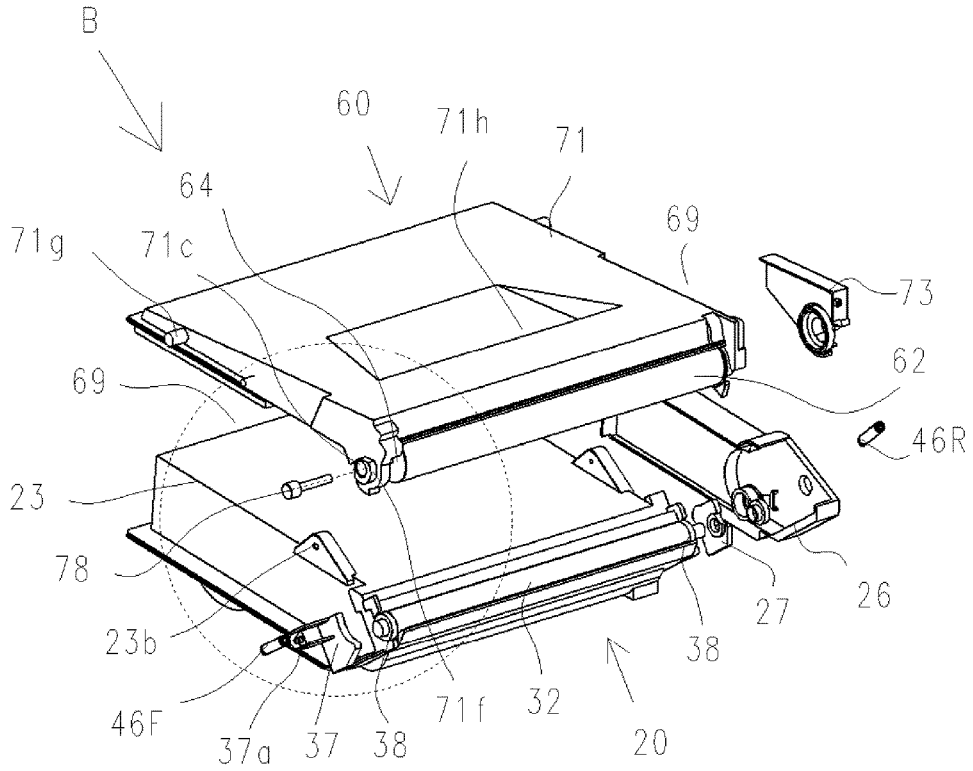
FIG. 10 is a general perspective view of the process cartridge in which the feeding device in the First Embodiment is mounted as seen from a non-driving side.
Figure 11:
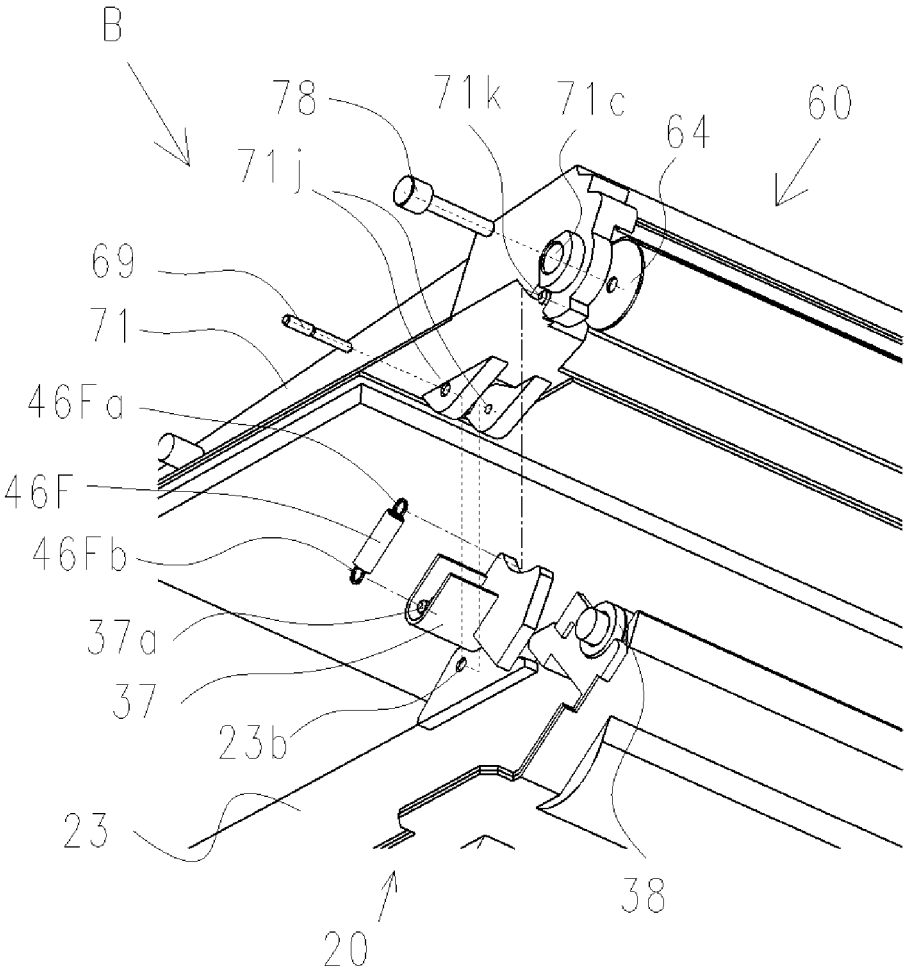
FIG. 11 is a partial perspective view of the process cartridge in which the feeding device in the First Embodiment is mounted as seen from the non-driving side.

Next, a general structure of the cartridge B will be described with reference to FIGS. 3, 4 and 10-13. FIG. 3 is a sectional view of the cartridge B. In FIG. 4, (a) is a side view of the cartridge B, and (b) is a sectional view showing an inside of the cleaning frame 71. FIG. 10 is a general perspective view of the cartridge B as seen from the non-driving side. FIG. 11 is a general perspective view of the cartridge B as seen from the non-driving side. FIG. 2 is a general perspective view of the cartridge B as seen from the driving side. FIG. 13 is a partial perspective view of the cartridge B as seen from the driving side.

In FIG. 4, (a) is the side view of the cartridge B as seen from the driving side, and (b) is the sectional view showing the inside of the cleaning frame 71 as seen in an arrow Y direction in (a) of FIG. 4. FIG. 11 is an enlarged view showing an inside of a dotted circle of FIG. 10 (but an angle thereof is changed). FIG. 13 is an enlarged view showing an inside of a dotted circle of FIG. 12 (but an angle thereof is changed). In this embodiment, screws used when respective parts (components) are connected will be omitted from illustration.

The cartridge B is formed by the cleaning unit 60 and the developing unit 20 as shown in FIG. 3. The cleaning unit 60 includes the drum 62, the charging roller 66 and the cleaning member 77, and these members are supported by the cleaning frame 71. Further, to the cleaning frame 71, a cleaning cover 72 is fixed by welding or the like. Further, each of the charging roller 66 and the cleaning member 77 is disposed in contact with the outer peripheral surface of the drum 62.

In FIG. 3, the cleaning member 77 is formed by a rubber blade 77*a* which is a blade-shaped elastic member and a supporting member 77*b* for supporting the rubber blade 77*a*. The rubber blade 77*a* contacts the drum 62 counter directionally to a rotational direction of the drum 62. That is, the rubber blade 77*a* contacts the drum 62 so that a free end portion thereof faces toward an upstream side with respect to the rotational direction of the drum 62.

A residual toner (waste toner) removed from the surface of the drum by the cleaning member 77 is sequentially fed in the following manner. That is, as shown in (b) of FIG. 4, the residual toner is fed in directions of arrows V, W and X in a named order by a first screw 86, a second screw (first feeding member) 87 and a third screw (second feeding member) 88, respectively, as a residual toner feeding member. The residual toner is fed in the order of a cleaning chamber 71*e* and a residual toner feeding path 71*s* as shown in (b) of FIG. 4, and then is stored in a residual toner chamber 71*b* ((b) of FIG. 4), as an accommodating member (accommodating portion) for accommodating the developer (residual toner), formed by the cleaning frame 71 and the cleaning cover 72.

The first screw 86 is rotated by transmitting a driving force, received from the apparatus main assembly A by the cartridge B, through a gear (not shown) or the like. The second screw 87 is rotated by receiving the driving force from the first screw 86. The third screw 88 is rotated by receiving the driving force from the second screw 87. The first screw 86 is disposed in the neighborhood of the drum 62. The second screw 87 is disposed at a longitudinal end portion of the cleaning frame 71. The third screw 88 is disposed in the residual toner chamber 71*b*.

A rotational axis of the first screw 86 and a rotational axis of the third screw 88 are parallel to a rotational axis of the drum 62. A rotational axis of the second screw 87 is substantially perpendicular to the rotational axis of the photosensitive drum 62. An arrangement of the screws as a residual toner feeding means will be described later in detail.

In FIG. 3, a receptor sheet 65 for preventing the residual toner from leaking out of the cleaning frame 71 is provided at an end portion of the cleaning frame 71 so as to contact the drum 62. The drum 62 is rotationally driven in the arrow R direction in FIG. 3 depending on an image forming operation by receiving the driving force from a main assembly driving motor (not shown) which is a driving source.

The charging roller 66 is rotatably mounted to the cleaning unit 60 via charging roller bearings (not shown) at end portions thereof with respect to a longitudinal direction of the cleaning frame 71 (substantially parallel to a rotational axis direction of the drum 62). The charging roller 66 is press-contacted to the drum 62 by pressing the charging roller bearings toward the drum 62 by urging members (not shown). The charging roller 66 is rotated by rotation of the drum 62.

In FIG. 3, the developing unit 20 includes the developing roller 32 and the developing blade 42. The developing roller 32 and the developing blade 42 are supported by a developing container as the accommodating member for accommodating the developer. To the developing container 23, a bottom member 22 is fixed by welding or the like, whereby the toner supplying chamber 28 and the toner chamber 29 are formed. The toner supplying chamber 28 and the toner chamber 29 communicate with each other through a toner supply opening 30.

The developing roller 32 is a hollow member, and inside thereof, a magnet roller 34 is provided. The developing blade 42 regulates a toner layer (thickness) on the developing roller 32. As shown in FIG. 10, a gap-keeping member 38 is mounted to the developing roller 32 at each of end portions of the developing roller 32. By contact of the gap-keeping members 38 with the drum 62, the developing roller 32 is held so as to have a predetermined gap with the drum 62.

Further, as shown in FIG. 3, a leaking-out preventing sheet 33 is provided at an edge portion of the bottom member 22 so as to contact the developing roller 32. The leaking-out preventing sheet 33 prevents the toner from leaking out of the developing unit 20.

In the toner chamber 29, a first stirring member 43, a second stirring member 44 and a third stirring member 50 as rotatable members are provided. Each of the first stirring member 43, the second stirring member 44 and the third stirring member 50 rotates in the clockwise direction, and not only stirs the toner accommodated in the toner chamber 29 but also feeds the toner to the toner supplying chamber 28.

Figure 12:
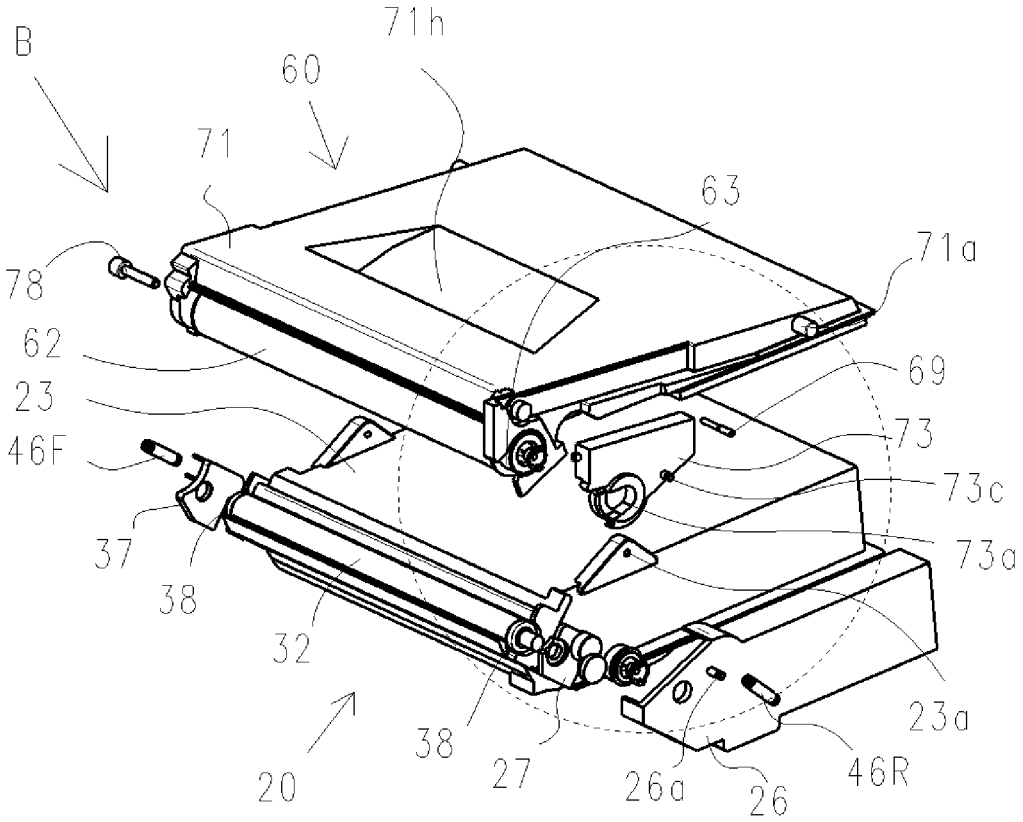
FIG. 12 is a general perspective view of the process cartridge in which the feeding device in the First Embodiment is mounted as seen from the non-driving side.
Figure 13:
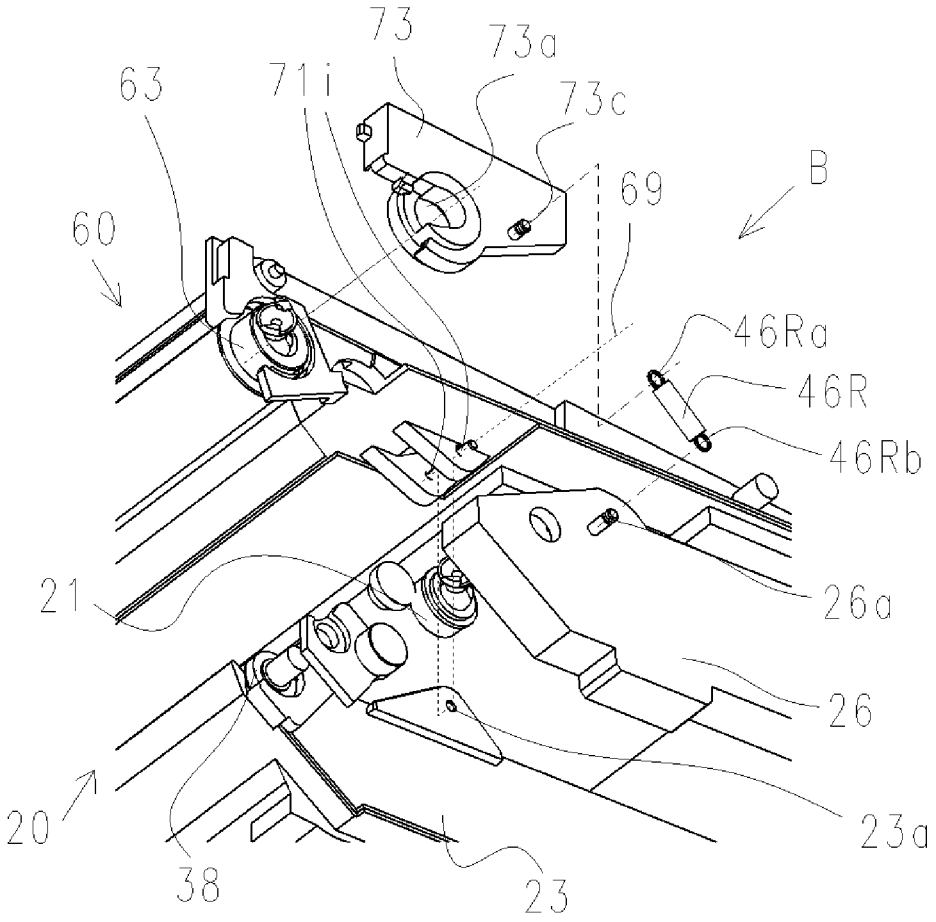
FIG. 13 is a partial perspective view of the process cartridge in which the feeding device in the First Embodiment is mounted as seen from a driving side.

The cleaning unit 60 includes, as shown in FIG. 12, the drum bearing 73 and a drum shaft 78. As shown in FIG. 13, on the driving side of the drum 62, a driving side drum flange 63 provided on the driving side is rotatably supported by a hole 73*a* of the drum bearing 3. In the non-driving side, as shown in FIG. 11, the drum shaft 78 press-fitted in a hole 71*c* provided in the cleaning frame 71 rotatably supports a hole (not shown) of a non-driving side drum flange 64.

On the other hand, as shown in FIGS. 10 and 12, in the developing unit 20, by bearing members 27 and 37 provided at end portions of the developing roller 32, the developing roller 32 is rotatably supported.

As shown in FIGS. 11 and 13, connection between the cleaning unit 60 and the developing unit 20 are made by rotatably connecting the cleaning unit 60 and the developing unit 20 by connecting pins 69 relative to each other. Specifically, in the driving side of the developing unit 20, as shown in FIG. 13, a developing-first supporting hole 23*a* is provided as a part of the developing container 23. In the non-driving side, as shown in FIG. 11, a developing-second supporting hole 23*b* is provided as a part of the developing container 23.

Further, in the driving side of the cleaning unit 60, as shown in FIG. 13, first hanging holes 71*i* are provided as a part of the cleaning frame 71. In the non-driving side, as shown in FIG. 11, second hanging holes 71*j* are provided as a part of the cleaning frame 71. In the driving side, as shown in FIG. 13, the connecting pin 69 press-fitted and fixed in the first hanging holes 71*i* and the first supporting hole 23*a* engage with each other. In the non-driving side, as shown in FIG. 11, the connecting pin 69 press-fitted and fixed in the second hanging holes 71*j* and the second supporting hole 23*b* engage with each other. By the above-described constitution, the developing unit 20 is rotatably connected with the cleaning unit 60.

Further, as shown in FIG. 13, a first hole 46Ra of a driving side-urging member 46R is hooked on a boss 73*c* of the drum bearing member 73, and a second hole 46Rb of the driving side-urging member 46R is hooked on a boss 26*a* of the driving side-developing side member 26. Further, as shown in FIG. 11, a first hole 46Fa of a non-driving side-urging member 46F is hooked on a boss 71*k* of the cleaning frame 71, and a second hole 46Fb of the non-driving side-urging member 46F is hooked on a boss 37*a* of the bearing member 37.

As described above, in this embodiment, each of the driving side-urging member 46R and the non-driving side-urging member 46F is formed with a tension spring, and the developing unit 20 is urged toward the cleaning unit 60 by an urging force of these springs, so that the developing roller 32 is pressed toward the drum 62 with reliability.

(Residual Toner Feeding Structure and Feeding Operation)

Figure 1:
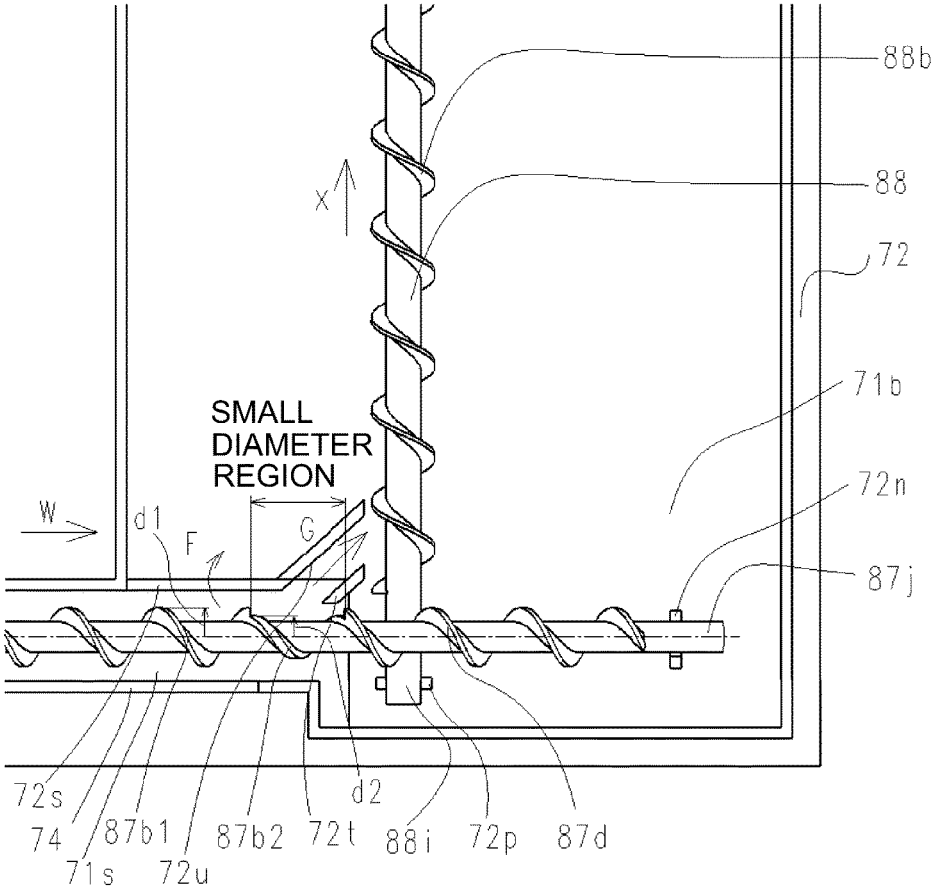
In FIG. 1, (a) is a top (plan) view of a crossing portion between a second screw as a first feeding member and a third screw as a second feeding member according to a feeding device in a First Embodiment, and (b) is a side view of the crossing portion.
Figure 1:
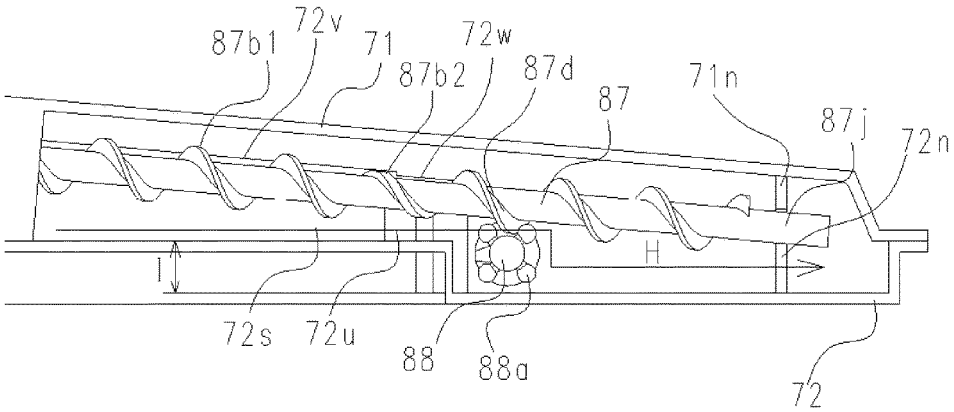

A general residual toner feeding structure by the first screw 86, the second screw 87 (first feeding member) and the third screw (second feeding member) will be described with reference to FIGS. 1, 4, 14, 15 and 16. In FIG. 1, (a) is a partially detailed view of a crossing portion between the second screw 87 and the third screw 88 shown in (b) of FIG. 4, as seen from above. The crossing portion refers to an overlapping position between the screws when the screws are viewed from above, and the second and third screws 87 and 88 are disposed in a twist relationship in actuality.

Figure 14:
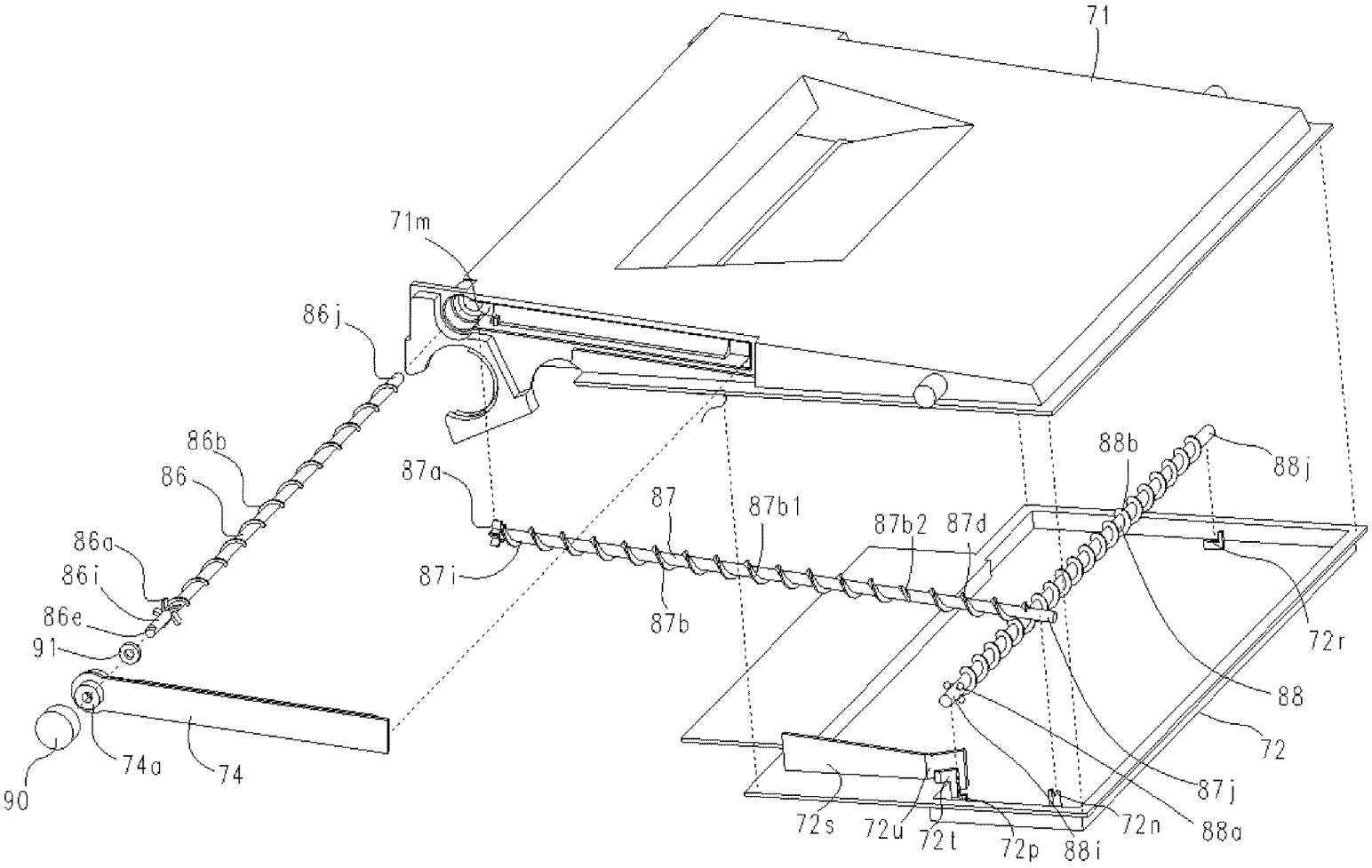
FIG. 14 is an exploded perspective view of the process cartridge in which the feeding device in the First Embodiment is mounted as seen from the driving side.
Figure 15:
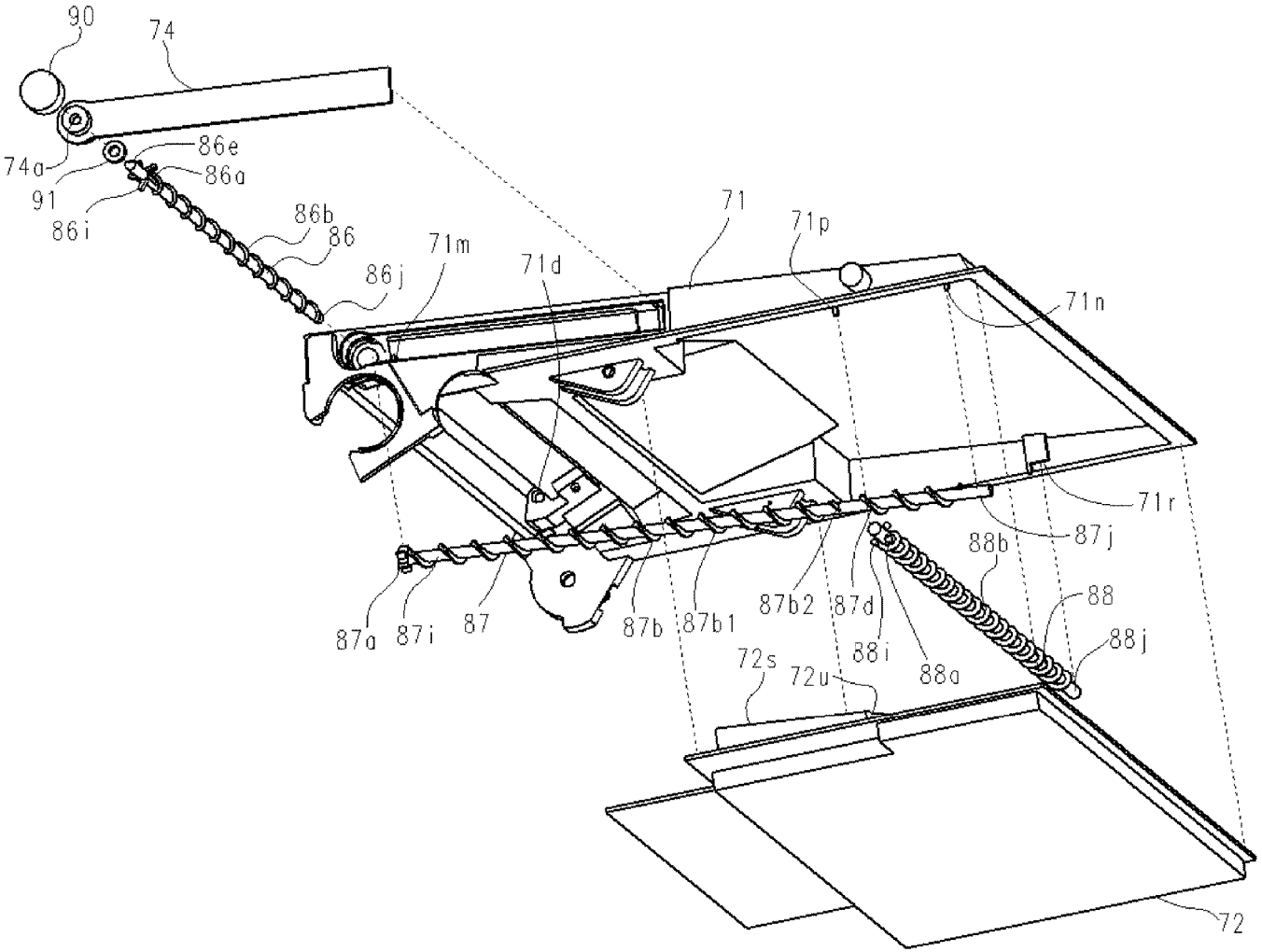
FIG. 15 is an exploded perspective view of the process cartridge in which the feeding device in the First Embodiment is mounted as seen from the driving side.
Figure 16:
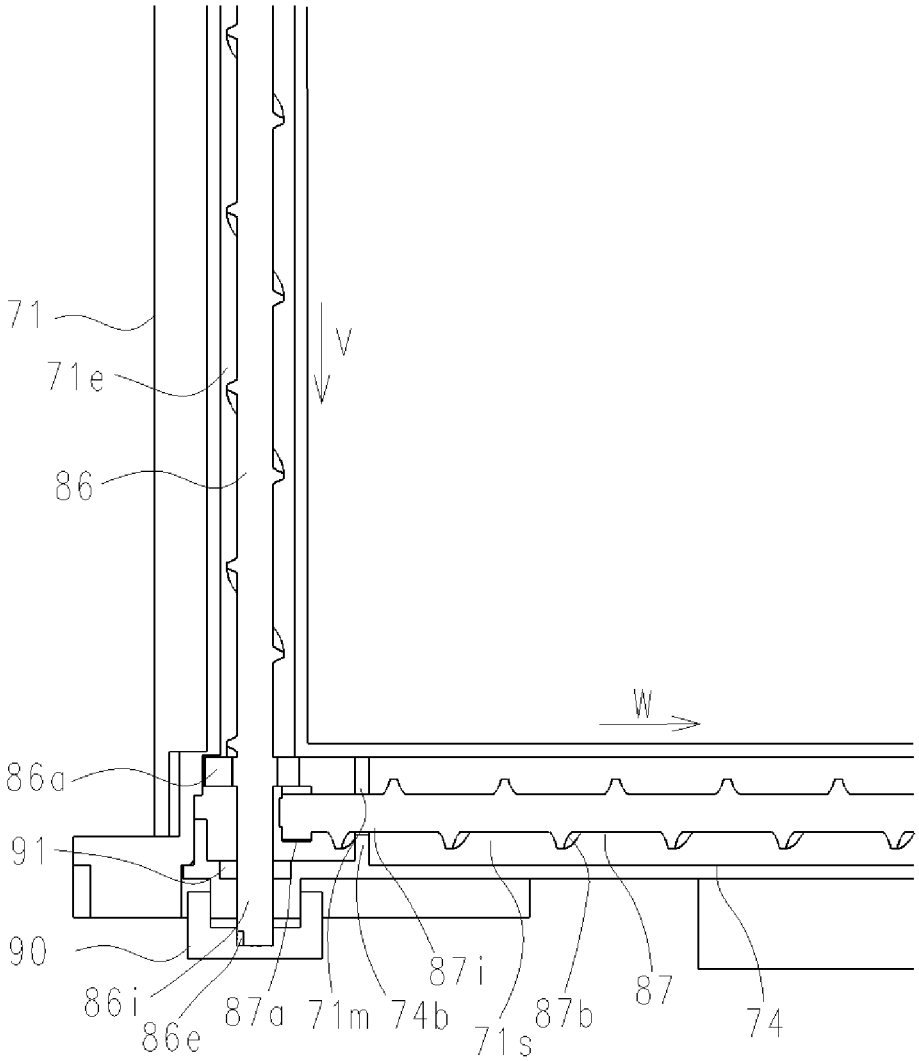
FIG. 16 is a top view of a crossing portion between a first screw as a third feeding member and the second screw as the first feeding member in the feeding device in the First Embodiment.

In FIG. 1, (b) is a side view of the screws 87 and 88 as seen in a side direction. FIG. 14 is an exploded perspective view of the cleaning unit 60 as seen from the driving side and from an upper side. FIG. 15 is an exploded perspective view of the cleaning unit 60 as seen from the driving side and from a lower side. FIG. 16 is a detailed view of a crossing portion between the first screw 86 and the second screw 87 shown in (b) of FIG. 4.

1) Residual Toner Delivering Structure from First Screw to Second Screw

As shown in (b) of FIG. 4 and FIGS. 14-16, the first screw 86 and the second screw 87 are rotatably held in the cleaning chamber 71*e* and the residual toner feeding path 71*s* which are formed by the cleaning frame 71 and a screw cover 74.

Specifically, as shown in FIGS. 14-16, the first screw 86 is constituted by a driving portion 86*a*, a driven portion 86*e*, a screw portion 86*b*, and shaft portions 86*i* and 86*j*. Further, the second screw 87 is constituted by a driven portion 87*a*, a driving portion 87*d*, a screw portion 87*b*, and shaft portions 87*i* and 87*j*.

In FIG. 15, the shaft portion 86*i* provided at one end portion of the first screw 86 in the driven portion 86*e* side is inserted into a hole 74*a*, and the shaft portion 86*j* provided at the other end portion of the first screw 86 is inserted into a hole 71*d* provided as a part of the cleaning frame 71.

Further, the shaft portion 87*i* provided at one end portion of the second screw 87 is abutted against a supporting rib 74*b* (FIG. 16) provided on the screw cover 74 and a supporting rib 71*m* (FIG. 16) provided on the cleaning frame 71. The shaft portion 87*j* provided at the other end portion of the second screw 87 is held by being abutted against two supporting ribs 71*n* and 72*n* (FIG. 15 and (b) of FIG. 4) formed by the cleaning frame 71 and the cleaning cover 72.

The screw cover 74 (FIG. 15, (b) of FIG. 4) is provided with a seal groove (not shown), and a sealing member consisting of an elastic member (e.g., rubber or elastomer) as a seal member (not shown) is provided in the seal groove and then is assembled with the cleaning frame 71 (FIG. 15, (b) of FIG. 4). By this sealing member, toner leakage from between the cleaning frame 71 and the screw cover 74 is prevented.

Further, in FIG. 15, the screw cover 74 is provided with the hole 74*a* for permitting projection of the first screw 86 toward an outside. Further, in a gap between the first screw 86 and the hole 74*a*, a sponge-shaped sealing member 91 is provided, so that leakage of the toner toward the outside is prevented.

In FIG. 15, the driven portion 86*e* of the first screw 86 has a D-cut surface, and passes through the hole 74*a* provided as a part of the screw cover 74 and projects to outside of the residual toner feeding path 71*s*, and then is connected with a gear 90. As a result, a rotational driving force of the gear 90 is transmitted to the first screw 86.

Further, the driving portion 86*a* of the first screw 86 is formed with 5 radial projections, and the driven portion 87*a* of the second screw is formed with 5 radial projections. Then, as shown in FIG. 16, the driving portion 86*a* of the first screw 86 and the driven portion 87*a* of the second screw 87 engage with each other, so that the rotational driving force of the first screw 86 is transmitted to the second screw 87.

In FIG. 14, the first screw 86 rotates in the clockwise direction as seen from the driven portion 86*e* side thereof, so that the residual toner scraped by the cleaning blade 77 is fed in the arrow V direction ((b) of FIG. 4) in the cleaning chamber 71*e* by the first screw 86. Then, in FIG. 14, the second screw 87 rotates in the counterclockwise direction as seen from the driven portion 87*a* side thereof, so that the residual toner is fed through the residual toner feeding path 71*s* in the arrow W direction ((b) of FIG. 4) by the second screw 87.

2) Residual Toner Delivering Structure from Second Screw to Third Screw

A general structure for feeding the residual toner by the second screw 87 as the first feeding member and the third screw 88 as the second feeding member will be described with reference to (a) and (b) of FIG. 1, FIG. 14 and FIG. 15.

As shown in (a) and (b) of FIG. 1 and (b) of FIG. 4, the third screw 88 is rotatably held in the residual toner chamber 71*b* formed by the cleaning frame 71 and the cleaning cover 72.

Specifically, as shown in FIG. 14, the third screw 88 is constituted by a driven portion 88*a*, a screw portion 88*b*, and shaft portions 88*i* and 88*j*, and the screw portion 88*b* is a left-handed (counterclockwise) screw. Further, as shown in FIG. 15, the shaft portions 88*i* and 88*j* provided at end portions of the third screw 88 are supported by being abutted against two supporting ribs 71*p* (FIG. 15) and 72*p* (FIG. 14) and two supporting ribs 71*r* (FIG. 15) and 72*r* (FIG. 14), respectively, formed by the cleaning frame 71 and the cleaning cover 72.

As shown in (b) of FIG. 1, the third screw 88 is provided vertically below the second screw 87 and crosses the second screw 87 at a position of the driving portion 87*d* of the second screw 87 as seen from above ((a) of FIG. 1). Further, the cleaning cover 72 is provided with a stepped portion corresponding to a height difference I ((b) of FIG. 1) between the second screw 87 and the third screw 88.

The driving portion 87*b* of the second screw 87 is provided helically at an intermediary position of the second screw 87 with respect to an axial direction as shown in (a) of FIG. 1, and the driven portion 88*a* of the third screw 88 is provided with 4 spheres-to-be-engaged as shown in (b) of FIG. 1 and FIG. 15. Further, the driving portion 87*b* of the second screw 87 and the driven portion 88*a* of the third screw 88 engage with each other, so that a rotational driving force of the second screw is transmitted to the third screw 88.

The screw portion 87*b* of the second screw 87 includes a helical screw large diameter portion 87*b*1 which has a first diameter (two times a radius d1 in (a) of FIG. 1) and which is provided in a first region, and includes a helical screw small diameter portion 87*b*2 which has a second diameter (two times a radius d2 in (a) of FIG. 1) smaller than the first diameter and which is provided in a second region in a named order with respect to an axial direction. Further, the helical screw small diameter portion 87*b*2 of the second screw 87 is provided upstream of the driving portion 87*d* provided at a driving position between the third screw 88 and the second screw 87 as seen from above, and by this small diameter portion 87*b*2, a toner feeding force is lowered as described specifically later.

The cleaning cover 72 forming the residual toner chamber 71*b* in combination with the cleaning frame 71 is provided with the following ribs. That is, in order to guide the residual toner to be fed, the cleaning cover 72 is provided with a first guide rib 72*s*, a second guide rib 72*t* (first wall), and a third guide rib 72*u* (second wall) which are shown in (a) of FIG. 1.

The first guide rib 72*s* is provided in parallel to the second screw 87 along the second screw 87. A position of the first guide rib 72*s* with respect to the axial direction of the second screw 87 is in a side upstream of the helical screw small diameter portion 87*b*2 of the second screw 87 with respect to a residual toner feeding direction. Further, as shown in (b) of FIG. 1, a height of an upper surface 72*v* of the first guide rib 72*s* is lower than a height of an upper surface of the second screw 87 as shown in (b) of FIG. 1.

The second guide rib 72*t* (first wall) is provided from a position close to the helical screw small diameter portion 87*b*2 of the second screw 87 toward the screw portion 88*b* of the third screw 88. Further, a closest position of the second guide rib 72*t* to the second screw 87 is a position where the helical screw small diameter portion 87*b*2 is provided when the second guide rib 72*t* is projected on the second screw 87. That is, the second guide rib 72*t* extends toward the third screw 88 as the second feeding member so that the second guide rib 72*t* is spaced from the second screw 87 as the first feeding member toward a downstream side of the second screw 87 with respect to a feeding direction (first feeding direction) of the second screw 87 to branch a flow path of the fed toner.

Thus, the second guide rib 72*t* form a new feeding path connecting the second screw 87 and the third screw 88. Incidentally, a height of an upper surface 72*w* of the second guide rib 72*t* is lower than a height of the small diameter portion 87*b*2 of the second screw 87 similarly as in the case of the first guide rib 72*s* and the third guide rib 72*u* which are shown in (b) of FIG. 1.

In (a) of FIG. 1, the third guide rib 72*u* is provided opposed to and in parallel to the second guide rib 72*t*, as a pair of walls in combination with the second guide rib 72*t*. Further, the third guide rib 72*u* is connected with a downstream end of the first guide rib 72*s* positioned in a small diameter region of the second screw 87, and is provided toward the screw portion 88*b* of the third screw 88. Thus, the third guide rib 72*u* is spaced from the second screw 87 and extends toward the third screw 88 with a decreasing distance from a side upstream of the second guide rib 72*t* toward a downstream side of the second screw 87 with respect to the feeding direction of the second screw 87.

3) Residual Toner Feeding Route from Residual Toner Feeding Path to Residual Toner Chamber Next, a feeding route along which the residual toner fed in the order of the cleaning chamber 71*e* and the residual toner feeding path 71*s* by the first screw 87 and the second screw 88 is fed to the residual toner chamber 71*b* will be described. This feeding route roughly includes three directions consisting of a first direction F, a second direction H and a third direction G.

First, the first direction F shown in (a) of FIG. 1 will be described. The residual toner is fed in the axial direction by the helical screw large diameter portion 87*b*1 while being guided by the first guide rib 72*s* by rotating the second screw 87 in an opposite direction as seen from the driven portion 87*a* (FIG. 15) side of the second screw 87. Then, when an amount of the residual toner exceeds a certain amount, the residual toner gets over the first guide rib 72*s* and then is fed to a region in a side opposite from the first guide rib 72*s* side (first direction F).

Next, the second direction H shown in (b) of FIG. 1 will be described. The residual toner is fed in the axial direction inclined from the horizontal direction by the helical screw small diameter portion 87*b*2 by rotation of the second screw 87. Further, the residual toner is fed in the axial direction by the driving portion 87*d* of the second screw 87 (second direction H).

Next, the third direction G shown in (a) of FIG. 1 will be described. The residual toner is fed by the helical screw large diameter portion 87*b*1 and is then reduced in speed by the helical screw small diameter portion 87*b*2, so that a feeding force lowers. As a result, the residual toner in the region of the helical screw small diameter portion 87*b*2 shown in FIG. 1 is pushed by the residual toner sent by the helical screw large diameter portion 87*b*1 and spreads in a radial direction. Then, the residual toner is guided by the second guide rib 72*t* and the third guide rib 72*u* and thus is moved in the arrow G direction (third direction G).

The residual toner is further pushed and is dropped on the screw portion 88*b* of the third screw 88 by gravitation. Then, the third screw 88 rotates in the clockwise direction as seen from the driven portion 88*a* side thereof, whereby the residual toner is fed in an axial direction X ((a) of FIG. 1). As a result, the residual toner is uniformly fed into the residual toner chamber 71*b*.

As described above, according to this embodiment, a feeding force lowering portion for lowering the toner feeding force and guides are provided, so that delivery of the residual toner can be efficiently performed at the crossing portion between the second screw and the third screw 88.

First Modified Embodiment of First Embodiment

Figure 17:
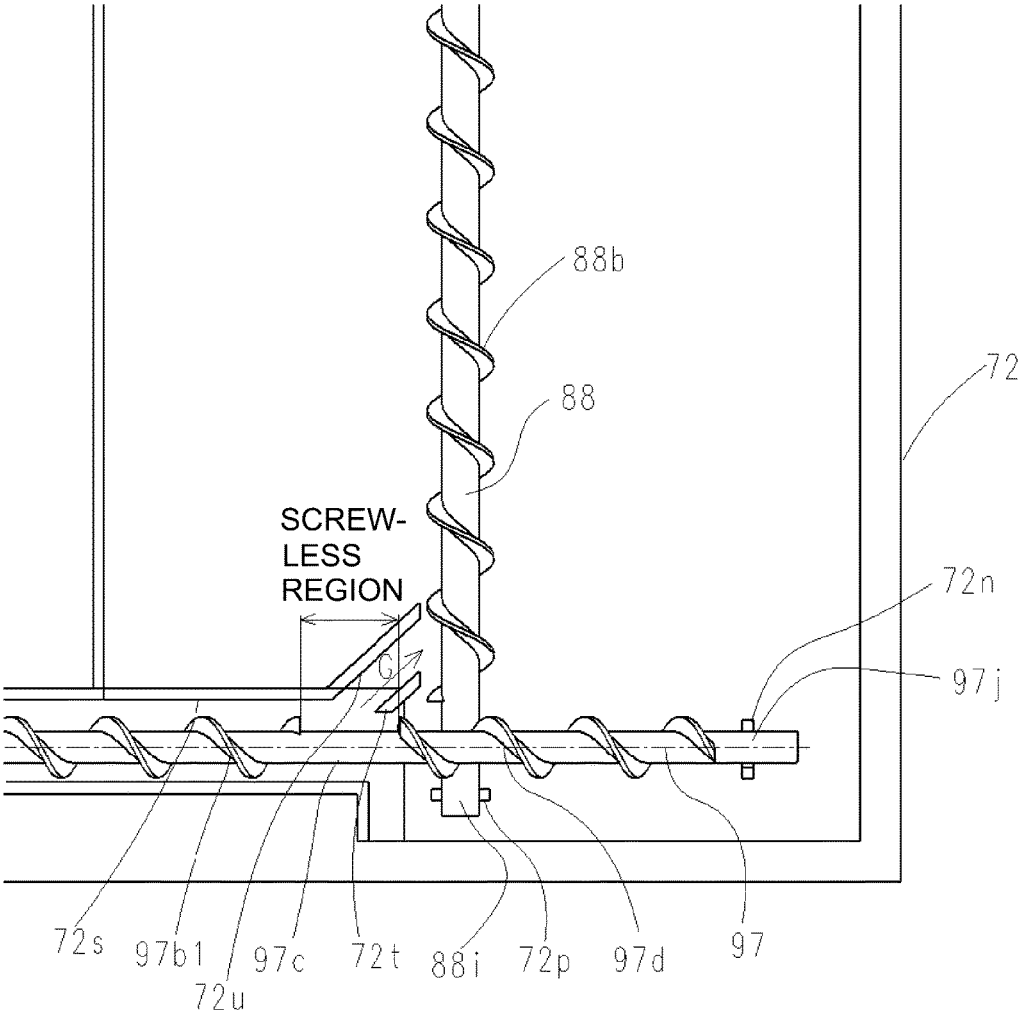
FIG. 17 is a top view of a crossing portion between the second downstream as the first feeding member and the third screw as the second feeding member in the feeding device in the First Embodiment.

FIG. 17 shows a modified embodiment different in shape of a second screw 97 from the First Embodiment and is a top (plan) view of a crossing portion between the second screw 87 and the third screw 88. In the First Embodiment, a spreading force of the residual toner in the radial direction is ensured by decreasing the diameter of the second screw 88, but in this modified embodiment, the region of the helical screw small diameter portion 87*b*2 of the second screw 87 in the First Embodiment is replaced with a region 97*c* where no helical portion is provided.

As a result, the residual toner in the region 97*c*, where no helical portion is provided, positioned upstream of a driving portion 97*d* is increased in feeding amount from the second screw 97 in the arrow G direction, so that the delivery of the residual toner can be performed further efficiently.

Second Modified Embodiment of First Embodiment

Figure 18:
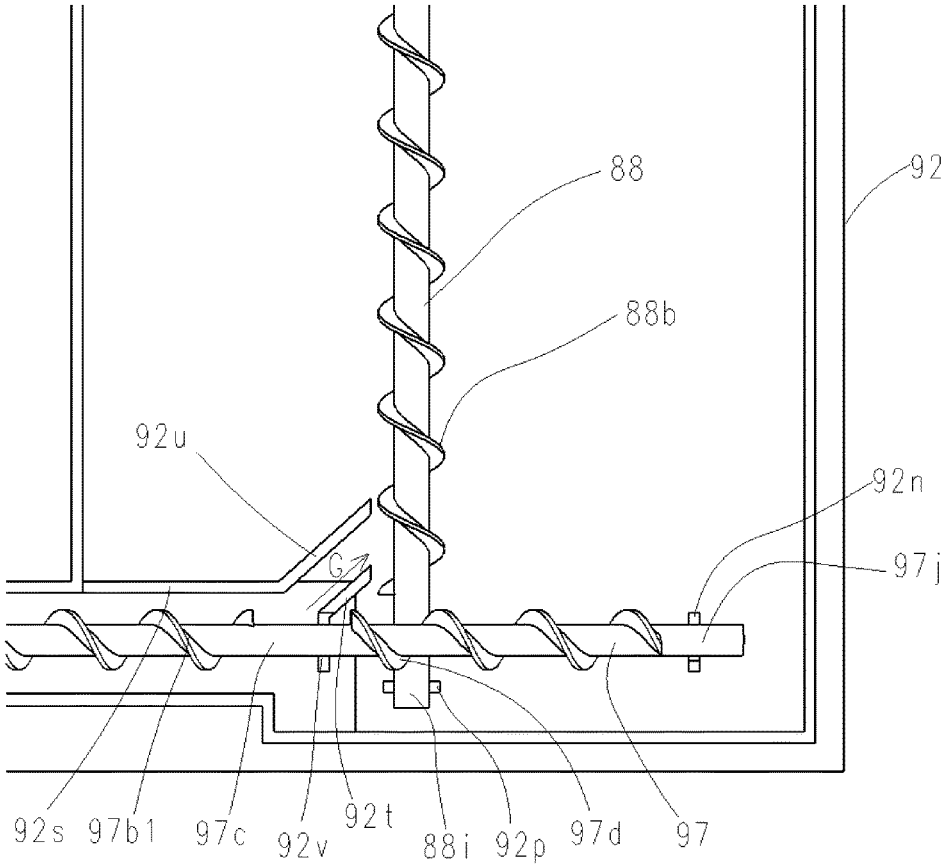
In FIG. 18, (a) and (b) are schematic views showing Modified Embodiment of the feeding device in the First Embodiment.
Figure 18:
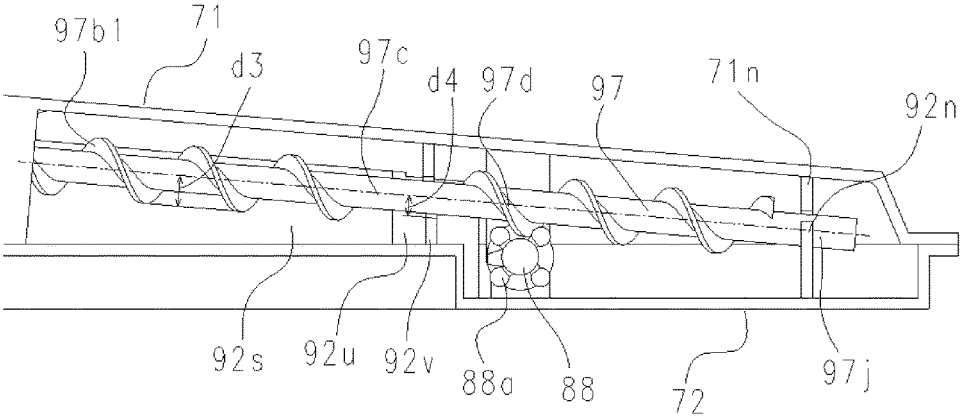

In FIG. 18, (a) and (b) show a modified embodiment in which the cleaning cover 72 in the above-described First Modified Embodiment is modified. In this modified embodiment, a fourth guide rib 92*v* is provided. This fourth guide rib 92*v* is provided upstream of the driving portion 97*d* of the second screw 97. The fourth guide rib 92*v* is provided on the cleaning cover 72 so as to overlap with a part of the helical screw large diameter portion 97*b*1 when the fourth guide rib 92*v* is projected on the helical screw large diameter portion 97*b*1 side. That is, a distance d4 ((b) of FIG. 18) from an axial line of the second screw 97 to an inside position of the fourth guide rib 92*v* is smaller than a rotation radius d3 of the helical screw large diameter portion 97*b*1. As a result, a feeding amount of the residual toner from the second screw 97 in the arrow G direction is increased, so that the delivery of the residual toner can be performed further efficiently.

Second Embodiment

Figure 19:
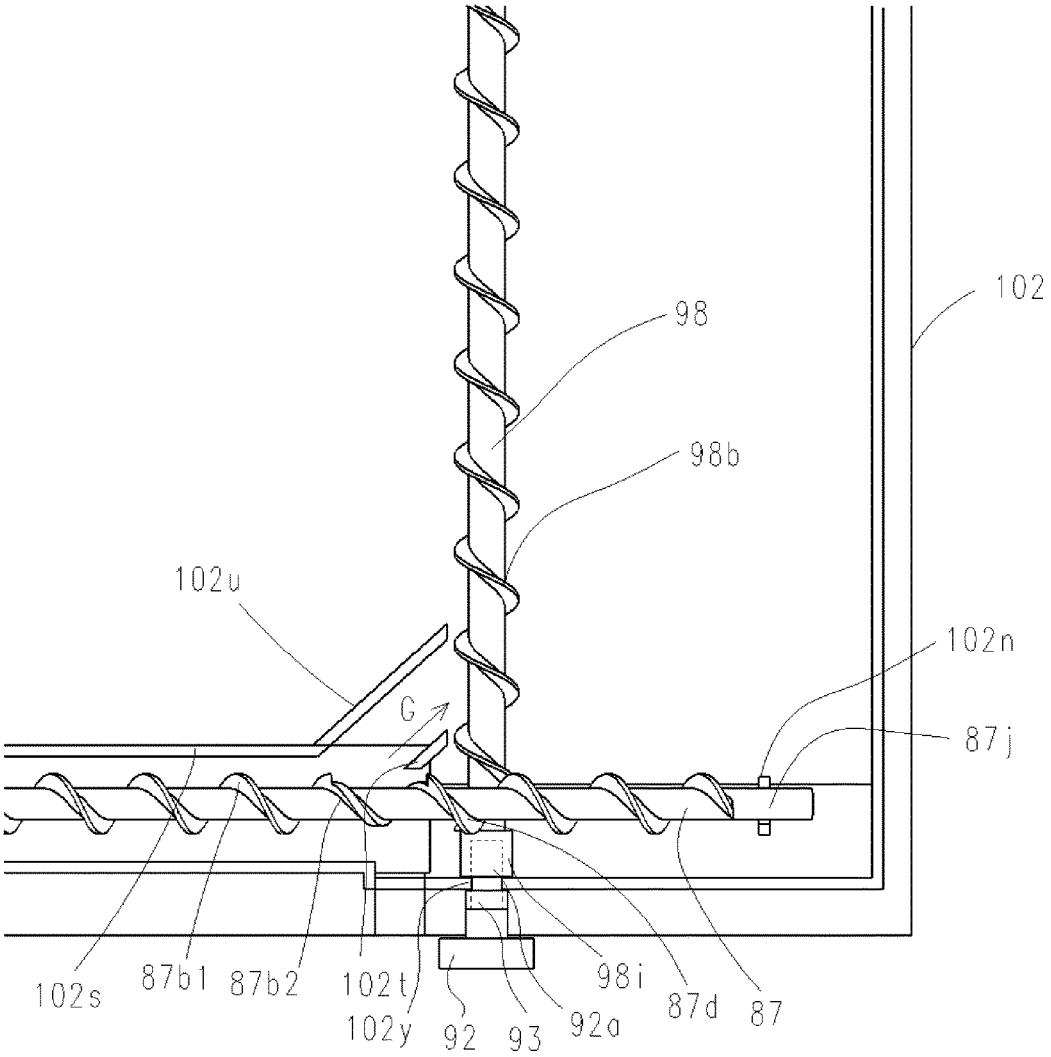
FIG. 19 is a top view of a crossing portion between a second screw as a first feeding member and a third screw as a second feeding member in a feeding device in a Second Embodiment.

The Second Embodiment of the present invention will be described with reference to FIG. 19. In the First Embodiment, the drive of the third screw 88 was made by the second screw 87, but in this embodiment, drive of a third screw 97 is made by connecting a gear 92. That is, in this embodiment, the second screw 87 as the first feeding member and a driving source for the third screw 98 as the second feeding member are different from those in the First Embodiment. In the Second Embodiment, a portion different from that in the First Embodiment will be described in detail. Unless otherwise specified, materials and shapes of portions are similar to those in the First Embodiment. The portions are represented by the same reference numerals or symbols and will be omitted from detailed description.

In this embodiment, the third screw 98 is provided vertically below the second screw 87 and crosses the second screw 87 at a position of the driving portion 87*d* as seen from above. In this embodiment, similarly as in the First Embodiment, the toner feeding force is lowered by the small diameter portion 87*b*2 of the second screw 87.

The cleaning cover 72 forming the residual toner chamber 71*b* in combination with the cleaning frame 71 is provided with a first guide rib 102*s*, a second guide rib 102*t* (first wall) and a third guide rib 102*u* (second wall) in order to guide the residual toner to be fed.

The first guide rib 102*s* is provided in parallel to the second screw 87 along the second screw 87. A position of the first guide rib 102*s* with respect to the axial direction of the second screw 87 is in a side upstream of the helical screw small diameter portion 87*b*2 of the second screw 87 with respect to a residual toner feeding direction. Further, a height of an upper surface of the first guide rib 102*s* is lower than a height of an upper surface of the second screw 87.

The second guide rib 102*t* is provided from a position close to the helical screw small diameter portion 87*b*2 of the second screw 87 toward the screw portion 98*b* of the third screw 98.

As a result, the second guide rib 102*t* forms a new feeding path connecting the second screw 87 and the third screw 98. Incidentally, a height of an upper surface of the second guide rib 102*t* is lower than a height of the small diameter portion 87*b*2 of the second screw 87 similarly as in the case of the first guide rib 102*s* and the third guide rib 102*u*.

The third guide rib 102*u* is provided opposed to and in parallel to the second guide rib 102*t*, and is connected with a downstream end of the first guide rib 102*s* positioned in a small diameter region of the second screw 87, and is provided toward the screw portion 98*b* of the third screw 98.

In this embodiment, the third screw 98 is constituted by a screw portion 98*b*, shaft portions (not shown) and a connecting portion 98*i*. The third screw 98 is connected with a shaft 92*a* of the gear 92 mounted in a hole 102*y* provided as a part of a cleaning cover 102, so that a driving force is transmitted to the third screw 98. Further, between the shaft 92*a* provided on the cleaning cover 102 and the hole 102*y*, a sealing member 93 is provided, so that leakage of the residual toner is prevented.

As described above, as in this embodiment, even when the drive of the third screw is externally made, the delivery of the residual toner can be efficiently performed similarly as in the First Embodiment.

Third Embodiment

Figure 20:
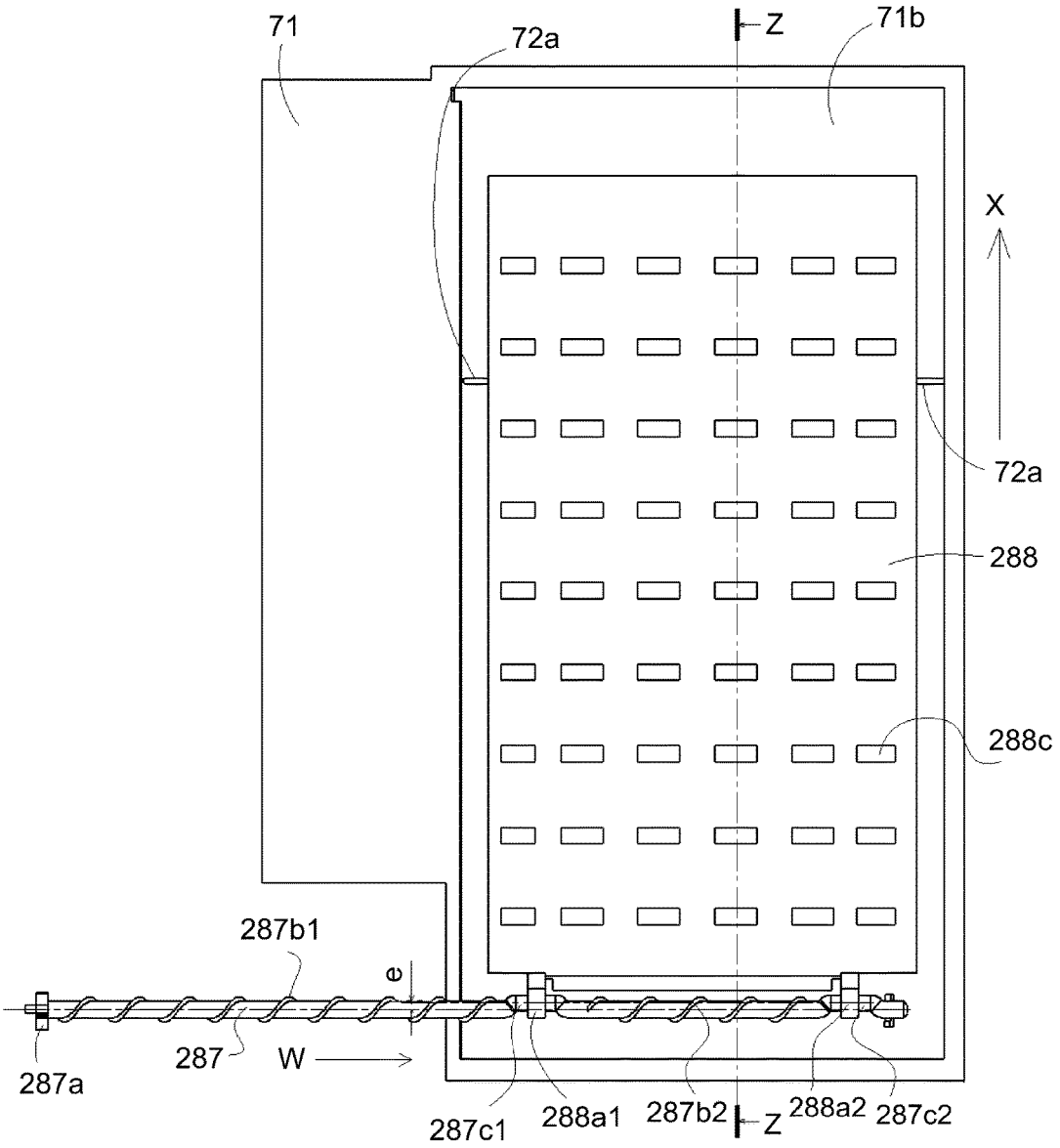
FIG. 20 is a top view of a crossing portion between a second screw as a first feeding member and a plate-shaped member as a second feeding member in a feeding device in a Third Embodiment.
Figure 21:
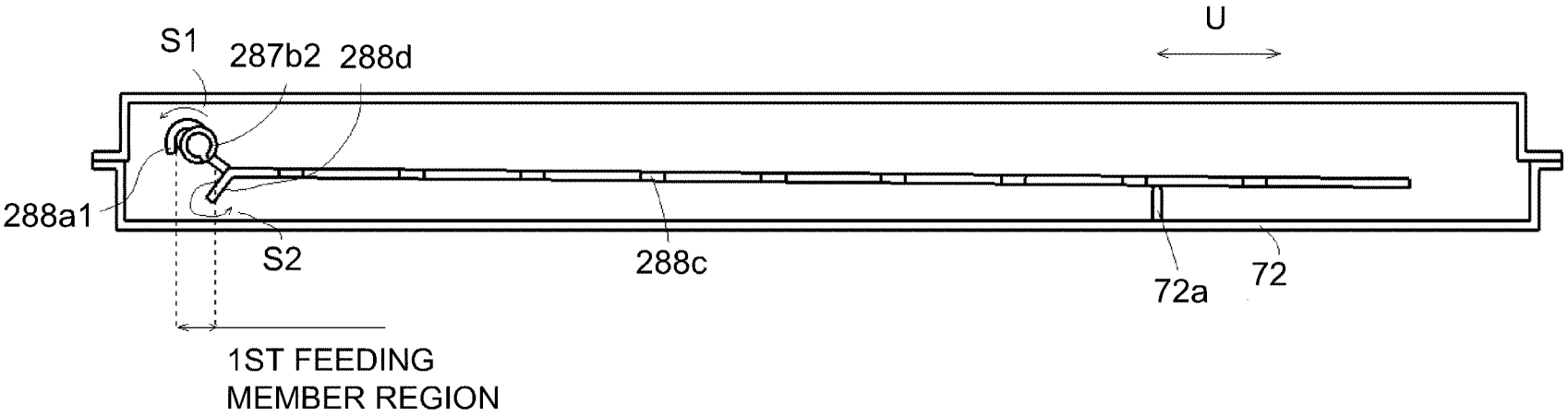
FIG. 21 is a sectional view of the feeding device in the Third Embodiment.

The Third Embodiment of the present invention will be described with reference to FIGS. 20 and 21. FIG. 20 is a top view of a second screw 287 as a first feeding member, a plate-shaped member 288 as a second feeding member, and a cleaning cover 72. FIG. 21 is a sectional view of these members taken along Z-Z line of FIG. 20. Also in this embodiment, only a portion different from those in the above-described embodiments will be described in detail.

In FIG. 20, the second screw 287 includes a first screw portion 287*b*1 and a second screw portion 287*b*2. Further, the second screw 287 includes first and second crank-shaped portions 287*c*1 and 287*c*2 each having a predetermined crank amount e in order to rotatably support the plate-shaped member 288 as the second feeding member described below.

The second screw 287 includes portions-to-be-supported 288*a*1 and 288*a*2 rotatably supported by the crank-shaped portions 287*c*1 and 287*c*2 of the second screw 287 and includes a plurality of cut-away portions 288*c* for increasing a contact area of the residual toner. Further, the plate-shaped member 288 includes a toner feeding rib 288*d* (FIG. 21) described specifically later. Further, the cleaning cover 72 includes a contact rib 72*a* (FIG. 21) contacting the plate-shaped member 288.

Such a plate-shaped member 288 is rotatably supported at its portions-to-be-supported 288*a*1 and 288*a*2 by the crank-shaped portions 287*c*1 and 287*c*2 (FIG. 20) and contacts the contact rib 72*a*. Thus, by rotational motion of the second screw 287 as the first feeding member, the plate-shaped member 288 as the second feeding member is constituted so as to be capable of reciprocating in a U direction.

Further, in this embodiment, the rotational direction of the second screw 287 was constituted so as to be opposite to the rotational direction (S1 direction in FIG. 21) in the above-described embodiments. That is, also the direction of the screw portions 287*b*1 and 287*b*2 of the second screw 287 was constituted so as to be opposite to that in the above-described embodiments. Similarly, the rotational direction of an unshown first screw and the direction of screw portion of the first screw were constituted so as to be opposite to those in the above-described embodiments. The driving force transmission between the first screw and the second screw 287 is the same as those in the above-described embodiments, and will be omitted from description.

Next, residual toner feeding from the second screw 287 to the plate-shaped member 288 will be described. When the driving force is transmitted to the second screw 287 and thus the second screw 287 starts rotation, the residual toner is fed in a W direction of FIG. 20 by the first screw portion 287*b*1. When the residual toner reaches the crank-shaped portion 287*c*1, the toner feeding force is decreased.

Then, the toner decreased in feeding force is, similarly as in the above-described embodiments, pushed by the residual toner in a side (developing force receiving portion 287*a* side) upstream of the crank-shaped portion 287*c*1, and spreads in a radial direction. The residual toner spread in the radial direction is fed in an X direction in FIG. 20 reciprocating motion of the plate-shaped member 288.

The residual toner which is not fed toward the plate-shaped member 288 side at the crank-shaped portion 287*c*1 is fed in the W direction in FIG. 20 by the second screw portion 287*b*2 and thus is fed to the second crank-shaped portion 287*c*2. At the second crank-shaped portion 287*c*2, the residual toner feeding force is decreased again, so that the residual toner spreads in the radial direction and is fed in the X direction in FIG. 20 by the plate-shaped member 288.

As shown in FIG. 21, the residual toner feeding rib 288*d* entering a side vertically below the second screw portion 287*b* may also be provided on the plate-shaped member 288. The residual toner feeding rib 288*d* assumes a movement locus along an arrow S2 direction (FIG. 21) shown below a rotation region of the second screw 287. By the above-described constitution, the residual toner fed by the second screw 287 is fed toward the plate-shaped member 288 side by the residual toner feeding rib 288*d*, so that the above-described delivery of the residual toner can be further improved.

In this embodiment, the plate-shaped member 288 is provided with the plurality of cut-away portions 288*c*, whereby the contact area between the residual toner and the plate-shaped member 288 is increased and thus the residual toner feeding force is improved. In place of the plurality of cut-away portions 288*c*, a rib or the like may also be provided on the bottom of the plate-shaped member 288, so that a similar effect may also be achieved.

As described above, according to this embodiment, the first crank-shaped portion 287*c*1 which is a residual toner feeding force reducing portion is provided between the second screw portions 287*b*1 and 287*b*2, so that it is possible to efficiently perform the delivery of the residual toner between the second screw 287 and the plate-shaped member 288.

Modified Embodiments

Preferred embodiments of the present invention were described above, but the present invention is not limited thereto. Various modifications and changes of constitutions of the present invention are possible within the scope of the present invention.

Incidentally, with respect to functions, materials, shapes and relative arrangement of constituent elements described in the above embodiments, the scope of the present invention is not intended to be limited only to these parameters.

Modified Embodiment 1

In the First and Second Embodiments, the second guide ribs (first wall) 72*t* and 102*t* for forming the feeding path connecting the second screw as the first feeding member and the third screw as the second feeding member are provided on the cleaning cover 72, but the present invention is not limited thereto. That is, of the cleaning frame 71 and the cleaning cover 72 which form the residual toner chamber 71*b* as the accommodating member for accommodating the developer, the second guide ribs 72*t* and 102*t* may also be provided on the cleaning frame 71.

Modified Embodiment 2

The present invention having the constitutes relating to the screw members described in the above-described embodiments is not limited to those for feeding the residual toner. For example, the present invention may also be used for feeding the developer in the developing device including a developer carrying member (developing roller) for carrying the developer to be supplied to the photosensitive drum as the image bearing member.

Modified Embodiment 3

In the above-described embodiments, as the developer feeding member, the mechanism using the first screw and the second screw was described, but the developer feeding member is not limited to the screw. For example, the developer feeding member may also be a flexible sheet provided on a rotation shaft so as to feed the developer in a radial direction.

Modified Embodiment 4

In the above-described embodiments, the feeding device for feeding the developer is provided in the process cartridge insertable into the apparatus main assembly of the image forming apparatus, but may also be provided in an apparatus main assembly of an image forming apparatus in which the process cartridge is not used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-202499 filed on Oct. 14, 2015, which is hereby incorporated by reference herein in its entirety.

What is claimed is:

1. A feeding device for feeding a developer, comprising:

an accommodating member for accommodating the developer;

a first helical feeding member provided rotatably in said accommodating member and including a first region having a first diameter and a second region having a second diameter smaller than the first diameter in a named order with respect to a first feeding direction in which the developer is fed;

a second helical feeding member, provided rotatably in said accommodating member, for feeding the developer in a second feeding direction crossing the first feeding direction; and a wall provided in said accommodating member and extending toward said second helical feeding member so that said wall is spaced from said first helical feeding member toward a downstream side of said first helical feeding member with respect to the first feeding direction to branch a flow path of the developer, wherein with respect to the first feeding direction, the second region is provided between the first region and a position where said first and second helical feeding members cross each other.

2. A feeding device according to claim 1, further comprising a second wall provided in said accommodating member in parallel to said wall and extending toward said second helical feeding member from a position on a more upstream side than said wall with respect to the first feeding direction so that said second wall is spaced from said first helical feeding member toward the downstream side of said first helical feeding member with respect to the first feeding direction.

3. A feeding device according to claim 2, further comprising a third wall provided in said accommodating member in parallel to said first helical feeding member so as to be connected with said second wall.

4. A feeding device according to claim 1, wherein from an overlapping position of said wall with the second region in a view from the second feeding direction, said wall is spaced from said first helical feeding member toward the downstream side of said first helical feeding member with respect to the first feeding direction.

5. A feeding device according to claim 1, wherein said second helical feeding member is provided vertically below said first helical feeding member.

6. A cleaning device comprising:

a collecting member for collecting a developer from an image bearing member; and a feeding device according to claim 1 for feeding the developer collected by said collecting member to an accommodating portion.

7. A process cartridge insertable into a main assembly of an image forming apparatus, comprising:

an image bearing member; and a cleaning device according to claim 6.

8. An image forming apparatus comprising:

an image bearing member;

a cleaning device according to claim 6; and an exposure device for forming an electrostatic latent image on said image bearing member, wherein said image bearing member and said cleaning device are provided in a process cartridge or in a main assembly of said image forming apparatus in which the process cartridge is not used.

9. A developing device comprising:

a developer carrying member for carrying a developer supplied to an image bearing member; and a feeding device according to claim 1 for feeding the developer to said developer carrying member.

10. A process cartridge insertable into a main assembly of an image forming apparatus, comprising:

an image bearing member; and a developing device according to claim 9.

11. An image forming apparatus comprising:

an image bearing member;

a developing device according to claim 9; and an exposure device for forming an electrostatic latent image on said image bearing member, wherein said image bearing member and said developing device are provided in a process cartridge or in a main assembly of said image forming apparatus in which the process cartridge is not used.

12. A process cartridge insertable into a main assembly of an image forming apparatus, comprising:

an image bearing member; and a feeding device according to claim 1.

13. An image forming apparatus comprising:

an image bearing member;

a feeding device according to claim 1; and an exposure device for forming an electrostatic latent image on said image bearing member, wherein said image bearing member and said feeding device are provided in a process cartridge or in a main assembly of said image forming apparatus in which the process cartridge is not used.

14. A feeding device for feeding a developer, comprising:

an accommodating member for accommodating the developer;

a first feeding member provided rotatably in said accommodating member and including a first region having a helical shape, a second region having a crank shape and a third region having a helical shape in a named order with respect to a rotational axis direction; and a second feeding member supported in the second region and reciprocating in a direction crossing the rotational axis direction by rotational motion of said first feeding member.

15. A feeding device according to claim 14, wherein said second feeding member is a plate-shaped member.

16. A feeding device according to claim 15, wherein said plate-shaped member is provided with a plurality of cutaway portions.

17. A feeding device according to claim 14, wherein said second feeding member includes a feeding rib for feeding the developer, and wherein said feeding rib enters a region positioned vertically below the third region in a locus thereof along which said feeding rib reciprocates.

18. A cleaning device comprising:

a collecting member for collecting a developer from an image bearing member; and a feeding device according to claim 14 for feeding the developer collected by said collecting member to an accommodating portion.

19. A process cartridge insertable into a main assembly of an image forming apparatus, comprising:

an image bearing member; and a cleaning device according to claim 18.

20. An image forming apparatus comprising:

an image bearing member;

a cleaning device according to claim 18; and an exposure device for forming an electrostatic latent image on said image bearing member, wherein said image bearing member and said cleaning device are provided in a process cartridge or in a main assembly of said image forming apparatus in which the process cartridge is not used.

21. A developing device comprising:

a developer carrying member for carrying a developer supplied to an image bearing member; and a feeding device according to claim 14 for feeding the developer to said developer carrying member.

22. A process cartridge insertable into a main assembly of an image forming apparatus, comprising:

an image bearing member; and a developing device according to claim 21.

23. An image forming apparatus comprising:

an image bearing member;

a developing device according to claim 21; and an exposure device for forming an electrostatic latent image on said image bearing member, wherein said image bearing member and said developing device are provided in a process cartridge or in a main assembly of said image forming apparatus in which the process cartridge is not used.

24. A process cartridge insertable into a main assembly of an image forming apparatus, comprising:

an image bearing member; and a feeding device according to claim 14.

25. An image forming apparatus comprising:

an image bearing member;

a feeding device according to claim 14; and an exposure device for forming an electrostatic latent image on said image bearing member, wherein said image bearing member and said feeding device are provided in a process cartridge or in a main assembly of said image forming apparatus in which the process cartridge is not used.

* * * * *